United States Patent [19]

Tanzawa

[11] Patent Number: 5,003,355

[45] Date of Patent: Mar. 26, 1991

[54] DUPLEX RECORDING PAPER TRANSPORT CONTROL APPARATUS

[75] Inventor: Jun Tanzawa, Yokohama, Japan

[73] Assignee: Ricoh Company, Ltd., Tokyo, Japan

[21] Appl. No.: 503,739

[22] Filed: Apr. 3, 1990

[30] Foreign Application Priority Data

| | | | |
|---|---|---|---|
| Apr. 4, 1989 | [JP] | Japan | 1-83947 |
| May 2, 1989 | [JP] | Japan | 1-112028 |
| Dec. 22, 1989 | [JP] | Japan | 1-331198 |

[51] Int. Cl.[5] ..... G03G 21/00

[52] U.S. Cl. ..... 355/319; 271/186; 355/318; 355/24

[58] Field of Search ..... 355/319, 322, 318, 317, 355/24, 26; 271/186, 185, 65, 301, 303, 225; 358/498, 496, 488; 346/134

[56] References Cited

U.S. PATENT DOCUMENTS

| | | | |
|---|---|---|---|
| 4,825,245 | 4/1989 | Fukae et al. | 355/24 X |
| 4,956,678 | 9/1990 | Kiya et al. | 355/318 |

FOREIGN PATENT DOCUMENTS

| | | | |
|---|---|---|---|
| 2224013 | 4/1990 | United Kingdom | 271/186 |

*Primary Examiner*—A. T. Grimley

*Assistant Examiner*—Shuk Y. Lee

*Attorney, Agent, or Firm*—Cooper & Dunham

[57] ABSTRACT

The sheet transport control apparatus for controlling transport of a sheet is used in a duplex unit for a laser printer, the duplex unit having a transport system and a switchback system. The sheet transport control apparatus includes a transport path from an outlet of the printer through a first paper waiting position to a second paper waiting position, a first driving motor for transporting the sheet from the outlet of the printer to the first paper waiting position, a second driving motor for transporting the sheet temporarily waiting at the first paper waiting position to the switchback system and for switching back the sheet to the second paper waiting position, a first paper sensor for serving as a trigger to start the driving of the first driving motor to transport the sheet, a second paper sensor for serving as a start trigger for the second driving motor, the second paper sensor being provided at a position which is separated by a predetermined length from the second driving motor and allowing direction of the sheet slightly earlier than the time when a drive signal of the second driving motor turns off, so that the re-start timing of transporting of the sheet by the first and second motors is made earlier.

6 Claims, 30 Drawing Sheets

FIG. 23

| SEQ | POSITIONS | OPERATION | STEPS MOTOR 20/MOTOR 25 |
|---|---|---|---|
| (1) | 1ST PAPER SENSOR | MOTOR 20 STARTING (LO SPEED, FWD OPE) | X1 |
| (2) | (SHEET RR EDGE GOES THRU ROLLER 17) | SPEED OF MOTOR 20 INCREASE (HI SPEED, FWD OPE) | X2 |
| (3) | (SHEET FR EDGE REACHES POSITN 30) | MOTOR 20 TEMPORARILY STOPPING | O |
| (4) | | MOTOR 20 RE-STARTING (HI SPEED, FWD OPE) | X3 |
| (5) | (SHEET FR EDGE REACHES ROLLER 24) | MOTOR 25 STARTING (HI SPEED, FWD OPE) | X4 |
| (6) | (SHEET RR EDGE GOES THRU ROLLER 19) | MOTOR 20 STOPPING | Y1 |
| (7) | (SHEET RR EDGE REACHES ROLLER 24) | MOTOR 25 REVERSING (RR EDGE → FR EDGE) | Y2 |
| (8) | (SHEET FR EDGE REACHES POSITN 31) | MOTOR 25 TEMPORARILY STOPPING | Y3 |
| (9) | (PF COMMAND) | MOTOR 25 RE-STARTING (LO SPEED, REV OPE) | Y4 |
| (10) | (SHEET RR EDGE GOES THRU ROLLER 24) | MOTOR 25 STOPPING | |

DUPLEX RECORDING PAPER TRANSPORT CONTROL APPARATUS

BACKGROUND OF THE INVENTION

The present invention generally relates to a duplex recording sheet transport control apparatus, and more particularly to a duplex recording sheet transport control apparatus used in a printer or copying machine which makes double-sided prints.

As an example of the conventional apparatus, a single-side printing of a sheet carried out with a laser printer 1 shown in FIG. 21 will be described as follows. Recording sheets 6 are supplied from an upper paper cassette 2 or lower paper cassette 3 into a path indicated by the arrow A through a paper feeding device 4 or 5 (in this case, an upper paper feeding device 4 is used). These paper cassettes are attached removably to the printer and contain supply papers. The sheets 6 are transported to a latent image carrier including a photosensitive body 8 on a drum in a timing which is controlled with a pair of registration rollers 7. The photosensitive body 8 is rotated with the drum in a counterclockwise direction and at the same time the surface of the body is charged by an electrostatic charger 9. And laser beam L from a laser beam optical system 10 is applied to form an electrostatic latent image on the photosensitive body.

This latent image is changed with a toner into a visible image when the sheet passes through a developing device 11. The visible image is transferred through a transfer/separation charger 12 to the recording sheet 6 which is transported to the photosensitive body 8, and the sheet 6 in contact with the photosensitive body 8 is electrostatically separated. Then, the recording sheet 6 is transported to a fixing device 13 so that the visible image on the sheet 6 is fixed, and the sheet 6 is carried into a path indicated by the arrow B in this figure to a paper outlet 14.

Meanwhile, from the photosensitive body 8 after the visible image is transferred to the recording sheet, residual toner is removed by a cleaning device 15 having cleaning blades, and the removed toner is collected in the cleaning device 15.

Next, an overall description of the duplex recording or double-sided printing carried out for recording sheets 6 will be given below. As shown in FIG. 22, the single-sided prints (printed on the reverse side only) are further transported into a duplex apparatus 16 which is installed on the upper portion of the laser printer 1. In this apparatus the direction of transporting the sheet is reversed, and the sheet is again sent to the printer 1 which carries out again the single-side printing of the sheet on the opposite side (printed on the front side of the sheet in this case) and transports it to the paper outlet 14.

As shown in FIG. 22, the duplex recording apparatus 16 includes a transport system 16A and a switchback system 16B. The transport system 16A includes a first drive motor 20 for driving the rotation movements of a first transport roller 17, a second transport roller 18 and a third transport roller 19, a first paper sensor 21 provided on the upstream side of said first transport roller 17 along the sheet transport path for detecting the sheet front edge, a selector 22 used for changing the direction of transporting the sheet from a paper outlet roller 32 within the printer 1 to select a first paper transport path 101 with the rollers 17 through 19, and a solenoid 23 for driving said selector 22.

The switchback system 16B of the duplex recording apparatus 16 includes a switchback roller 24, a second drive motor 25 for driving rotary movement of said switchback roller, a switchback paper tray 26 for temporarily storing the sheet sent from the above-described first paper transport path 101, a selector 27 used for changing the direction of transporting the sheet from said switchback paper tray to select a second paper transport path 102 for the inverted sheet, and a solenoid 28 for driving said selector.

In FIG. 22 the position 30 indicates a first paper waiting position and the position 31 shows a second paper waiting position. A single-sided print (recorded on reverse side only) transported by the outlet roller 32 of the printer 1 to a third transport path 103 is further routed to the first transport path 101 by means of the selector 22. When the first paper sensor 21 senses the front edge of the sheet, it changes from the OFF state to the ON state to serve as a trigger to start the operation of the first and second drive motors 20 and 25. The amount of revolutions for these motors having stepping motors, or the sheet transport distances, are controlled with a magnetizing step number by a CPU (not shown) of the duplex recording apparatus control unit.

FIG. 23 is a diagram showing the magnetizing step numbers xi (i = 1 to 4) for the first drive motor 20 which starts operation when the first paper sensor 21 changes from the OFF state to the ON state, as well as the magnetizing step numbers yi (i = 1 to 4) for the second drive motor 25 which starts operation in the same manner. These magnetizing step numbers differ depending on the length of recording sheets, and are a fixed value determined primarily by the sheet type.

As is apparent from FIG. 23, in the conventional apparatus, the start timing (x1) is when the first paper sensor 21 changes from the OFF state to the ON state, and the first drive motor 20 temporarily stops operation (x2) when the sheet front edge reaches the first sheet waiting position 30.

Then the first drive motor 20 re-starts forward operation, and when the sheet front edge reaches the switchback drive motor 24 the second drive motor 25 starts operation (x3). When the sheet rear edge goes through the third transport roller 19, the first drive motor 20 stops operation (x4, y1). And the second drive motor 25 starts reverse operation with the sheet rear edge changing to the front edge (y2). While the second drive motor 25 stops, the sheet front edge reaches the second waiting position 31 (y3). Next, the second drive motor 25 re-starts operation to supply the next sheet to the printer 1, and then the second drive motor 25 stops operation.

In the conventional duplex recording apparatus, the timing of transporting the sheet from the first waiting position 30 to the switchback system 16B is determined based on the occurrence of the ON state in the sensor 21, and the re-starting of the first drive motor operation is performed simply after the OFF state of second drive motor 25 is sensed. Because of this, it is very difficult to adjust paper feed time intervals for a speedy printing. A paper feed time interval is referred to as a time period between paper feedings.

SUMMARY OF THE INVENTION

Accordingly, it is a general object of the present invention to provide a novel and useful duplex recording sheet transport control apparatus in which the above-described problem is eliminated to achieve increased paper transport speed for the duplex recording apparatus with shorter paper feed time intervals.

Another and more specific object of the present invention is to provide a duplex recording sheet transport control apparatus which comprises a first driving means for transporting a single-side recorded sheet from an outlet of a main recording apparatus through a sheet transport path to a first waiting position in a transport system of a duplex recording apparatus, a second driving means for transporting the single-side recorded sheet temporarily waiting at said first waiting position to a second waiting position in a switchback system of the duplex recording apparatus, a first paper detection means in said first driving means serving as a trigger to start operation of said first and second driving means, and a second paper detection means in said second driving means serving as a start trigger, said second paper detection means being provided on the downstream side of said second driving means along said sheet transport path and provided at a position which is separated by a distance determined by the transport speed from the center of a switchback drive roller of said second driving means, to enable said second paper detection means to detect the sheet slightly earlier than the timing of a drive signal of said second drive means becoming open, so that the timing of the restarting of forward operations of said first and second driving means is made earlier. According to the duplex recording sheet transport control apparatus of the present invention, it is possible to achieve increased sheet transport speed with shorter paper feed time intervals for the duplex recording apparatus by making the sensing by the second paper detection means slightly earlier than the timing of the switchback system's drive signal becoming open to the second driving means and by making the timing of the start of transporting of the second sheet, waiting at the first waiting position, to the switchback system at the end of the first sheet's reversing operation in the switchback system, allowing earlier re-start timing of forward operations of the first and second driving means.

Still another object of the invention is to provide a duplex recording sheet transport control apparatus which comprises a first driving means for transporting a single-side recorded sheet from an outlet of the main recording apparatus through a sheet transport path to a first waiting position in a transport system of the duplex recording apparatus, a second driving means for transporting the single-side recorded sheet temporarily waiting at said first waiting position to a second waiting position in a switchback system of the duplex recording apparatus, a first paper detection means in said first driving means serving as a trigger to start operation of said first and second driving means, and a second paper detection means in said second driving means serving as a start trigger, said second paper detection means being provided adjacent to said second driving means, a drive pulse counting means for counting drive pulses to said first driving means starting from the timing of the paper position being sensed, an adjusting means for adjusting a count value of said first driving means for stopping the driving pulses to said first driving means when the counted value reaches a predetermined value of a waiting position count, thus allowing said first paper waiting position to be adjustable. Said second paper detection means is provided on the upstream side of said first waiting position along said sheet transport path and provided at a position separated by a predetermined distance from said first waiting position.

According to the duplex recording sheet transport control apparatus of the present invention, when a single-sided print is temporarily waiting at the first waiting position while waiting for the operation of the second driving means, the driving pulses to the first driving means are counted, starting from when the second paper detection means senses the paper position, and the sending of such pulses to the first driving means is stopped to fix the first paper waiting position when the counted value (X1) reaches a predetermined count (X2) for the waiting position. At this time, the sheet front edge is located at the standard position (L1) on the downstream side of the third transport roller along the transport direction. Using an adjustment value (±X3), the count (X2) for the waiting position is adjusted so as to vary the waiting position in the distance range (±L3), corresponding to said adjustment value (±X3). Thus, it is possible to make adjustable the timing of the start of the operation of the second driving means to increase the transport speed of the duplex recording system.

Other objects and further features of the present invention will be apparent from the following description when read in conjunction with the accompanying drawings.

BRIEF DESCRIPTION OF THE DRAWINGS

FIG. 23 is a diagram for explaining how the first and second drive motors of the duplex recording apparatus as shown in FIG. 22 operate.

DETAILED DESCRIPTION

Figure 1:
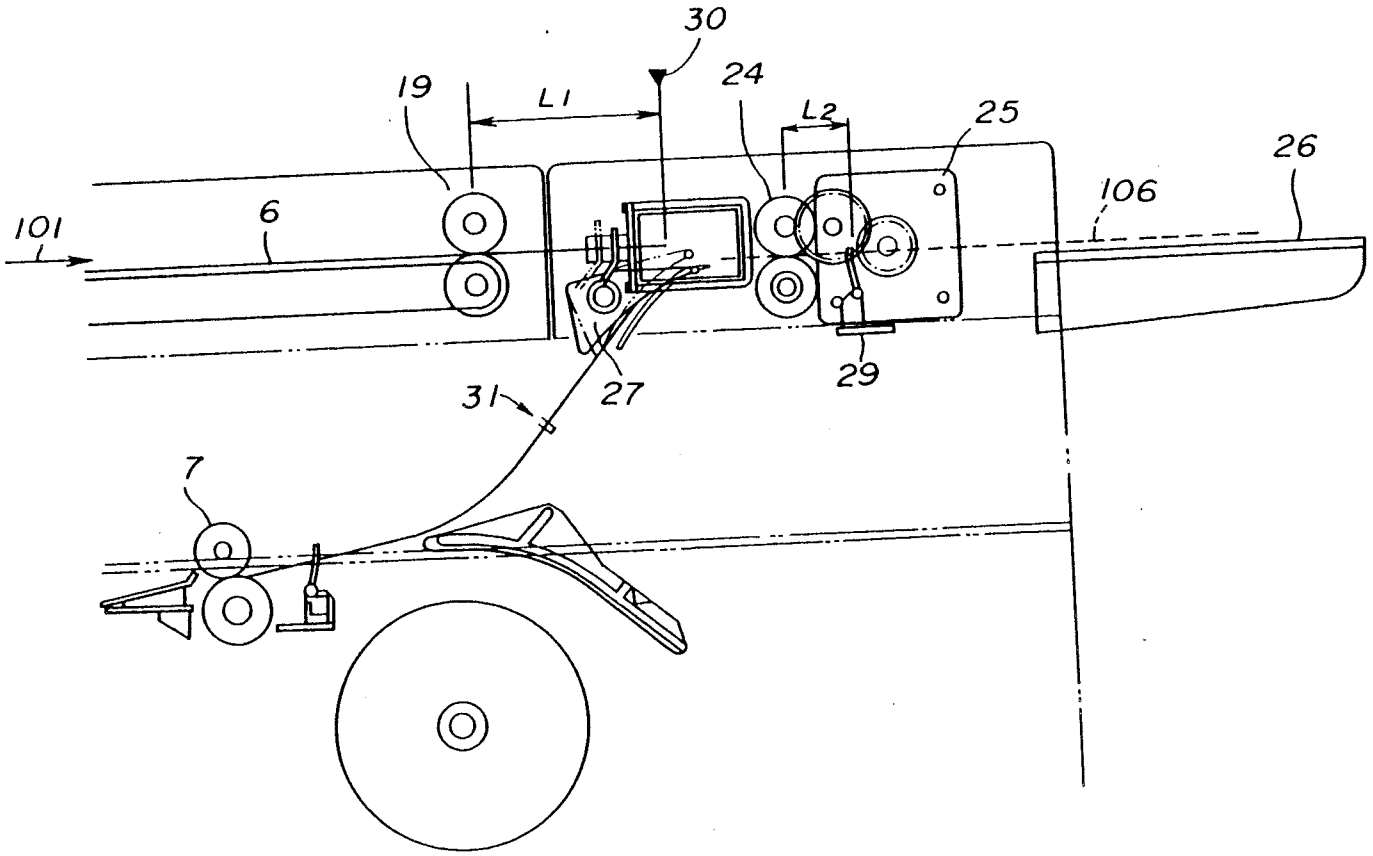
FIG. 1 is a schematic view showing an embodiment of a switchback system of a duplex recording apparatus according to the present invention.

Referring to FIGS. 1 through 9, an embodiment of the present invention will be described as follows. FIG. 1 is a schematic view of a switchback system 16B of a duplex recording apparatus. As shown in this figure, a second paper sensor 29 is provided at a position which is separated by a distance L2 in the downstream direction of a transporting path from the center of a switchback driving roller 24. This distance is a fixed value determined by the sheet transport speed (linear speed), and, for example, the L2 is set to 20 mm. A first waiting position 30 is provided at a position which is separated by a distance L1 (for example, L1=50 mm) toward the downstream direction of the transport of a sheet. At this position, a selector 27 is provided.

Figure 2:
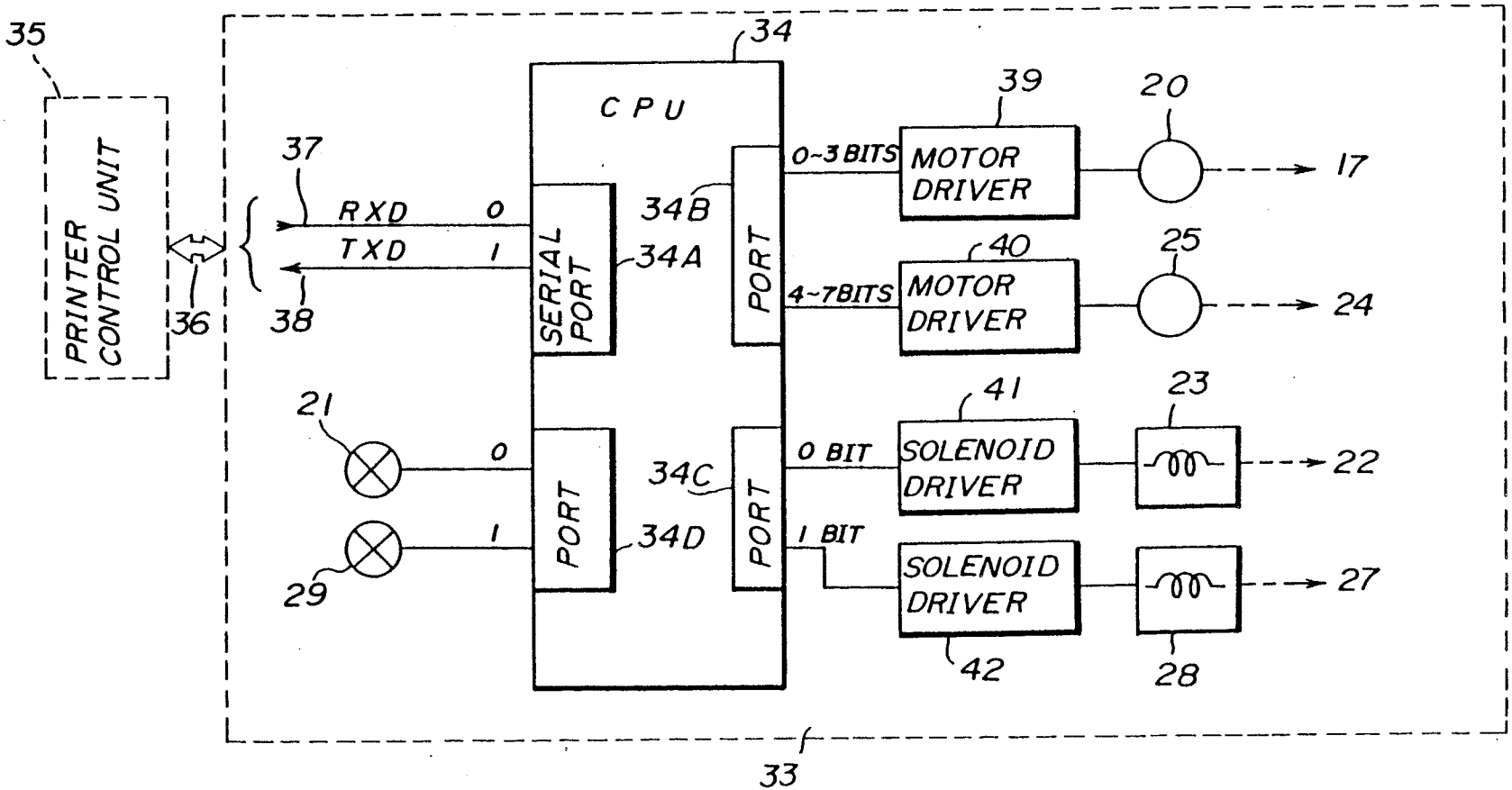
FIG. 2 is a system block diagram showing an embodiment of a control unit of the duplex recording apparatus according to the invention.

FIG. 2 is a system block diagram of a duplex recording apparatus control unit 33. As shown in this figure, a CPU 34 to control the overall behavior of the control unit 33 is connected through a serial circuit line 36 to a printer control unit 35. Receiving signals (RXD) 37 and transmitting signals (TXD) 38 flow along this line between the units. The command analysis of receiving signals 37 is carried out by software processing in the CPU 34. Two transport systems 16A and 16B of the duplex recording apparatus drive motor drivers 39 and 40 connected to a port 34B and solenoid drivers 41 and 42 connected to a port 34C.

The front edge detection outputs from a first paper sensor 21 and a second paper sensor 29 are taken through a port 34D into the CPU 34 to act as a trigger to determine the sheet transport timing. The CPU 34 sends transmitting signals (TXD) 38 from the serial port 34A to the printer control unit 35 to control the operation timing of the printer.

Figure 3:
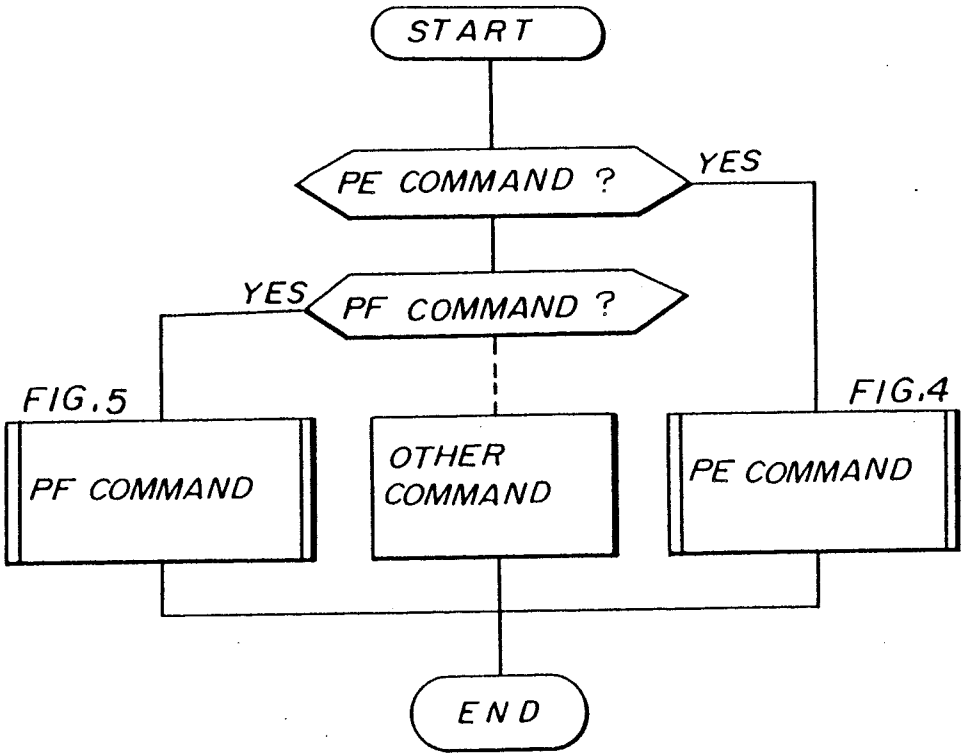
FIG. 3 is an overall flow chart used for the control unit of the duplex recording apparatus.

FIG. 3 is a flow chart of a PE (paper eject) and PF (paper feed) command processing of the duplex recording apparatus control unit 33. The PE command processing and the PF command processing are performed according to the flow charts of FIG. 4A through 4D and FIG. 5.

Figure 4A:
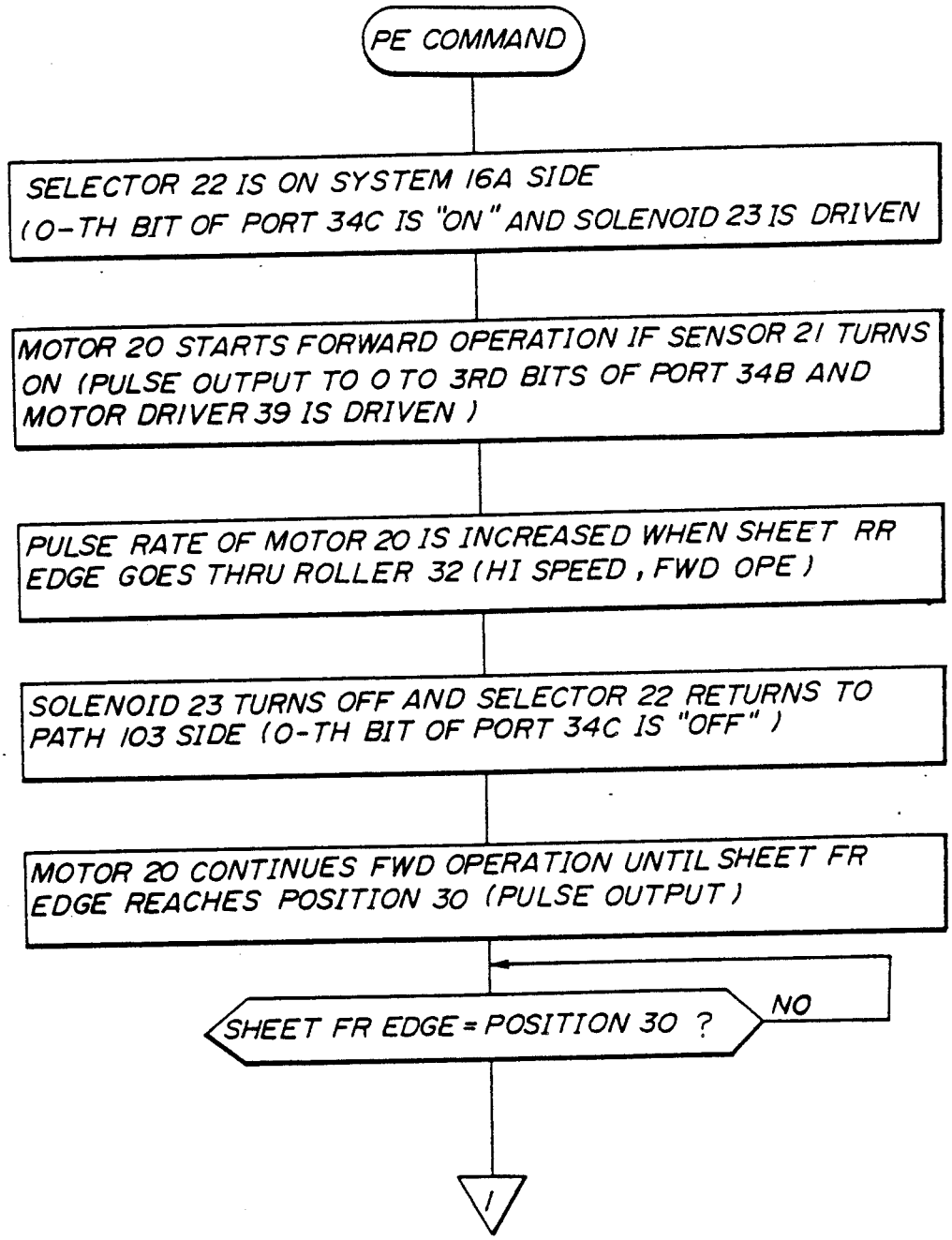
FIGS. 4A through 4D are a flow chart showing the paper eject (PE) command processing in FIG. 3.
Figure 4B:
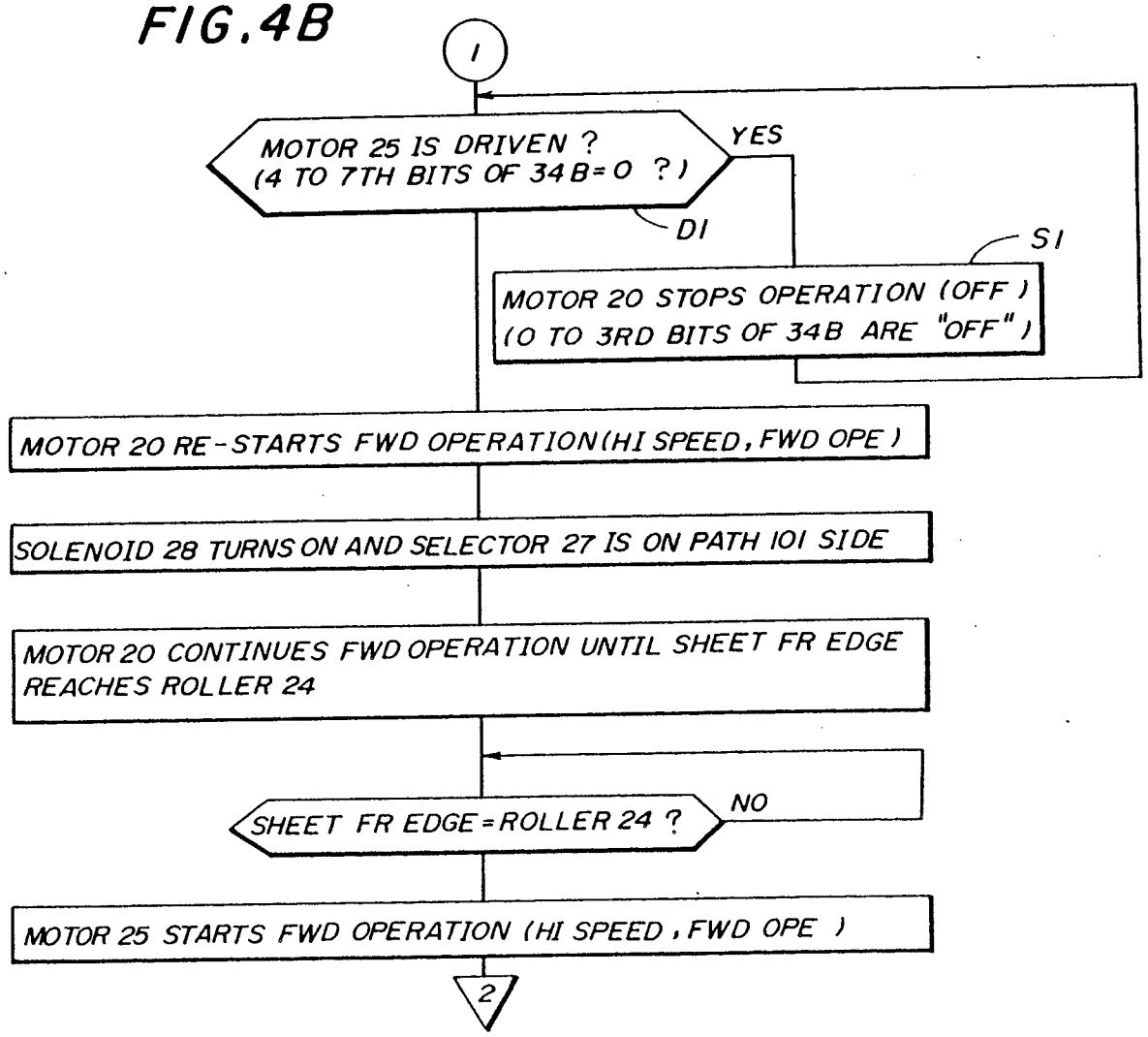
Figure 4C:
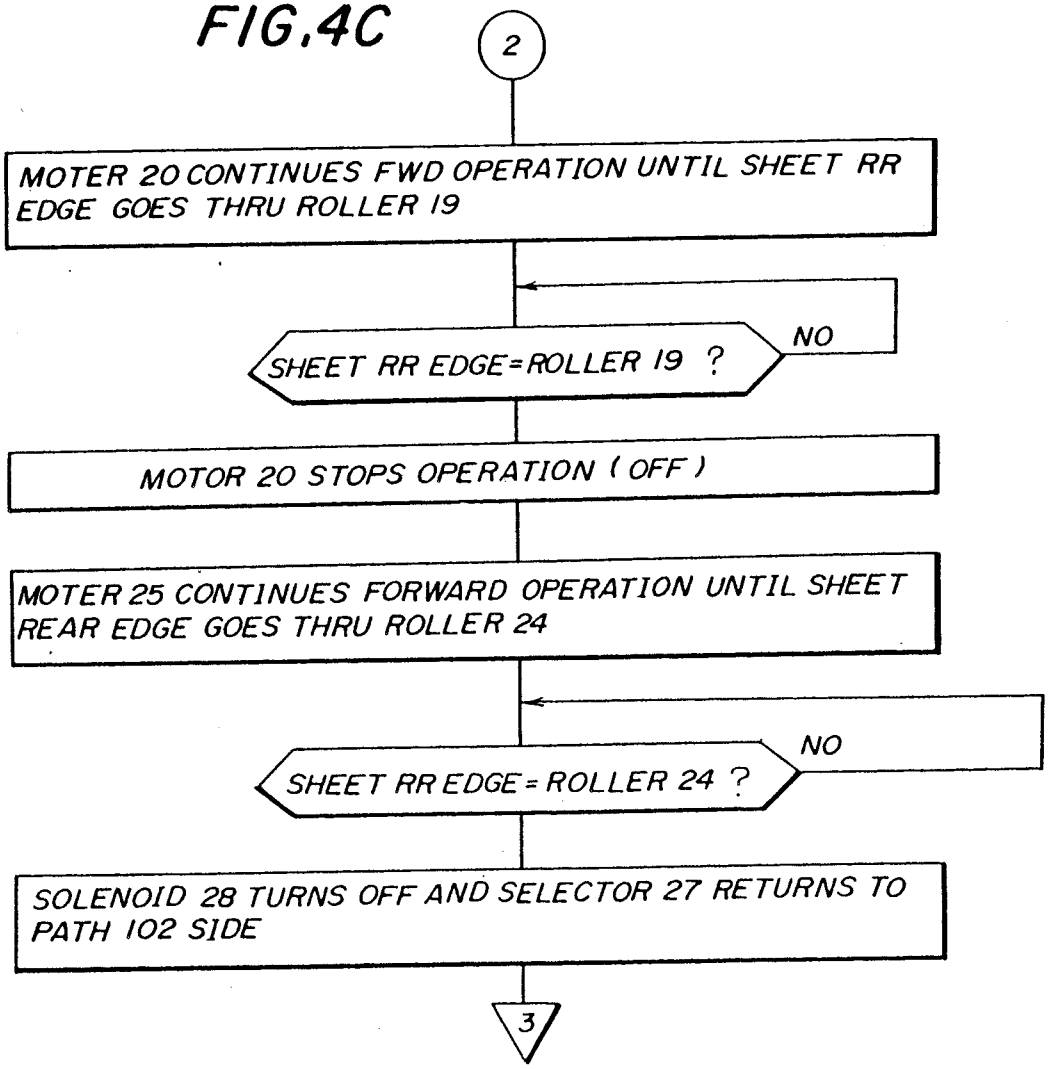
Figure 4D:
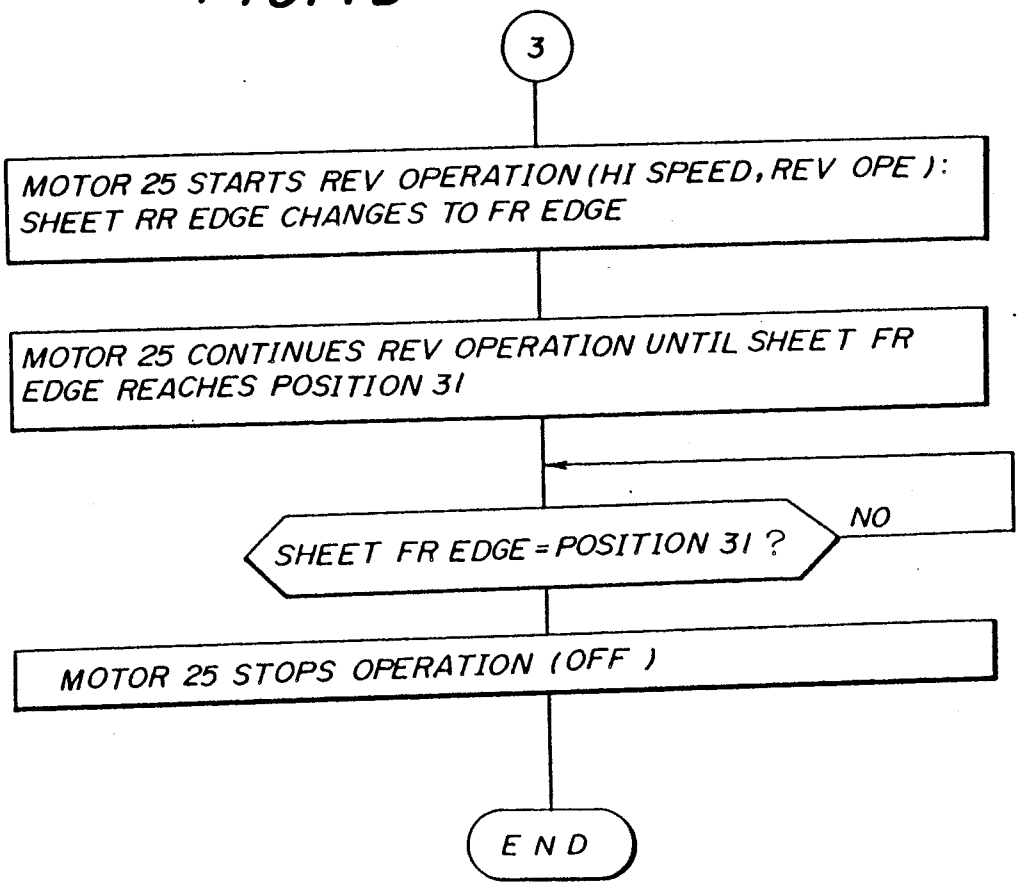
Figure 5:
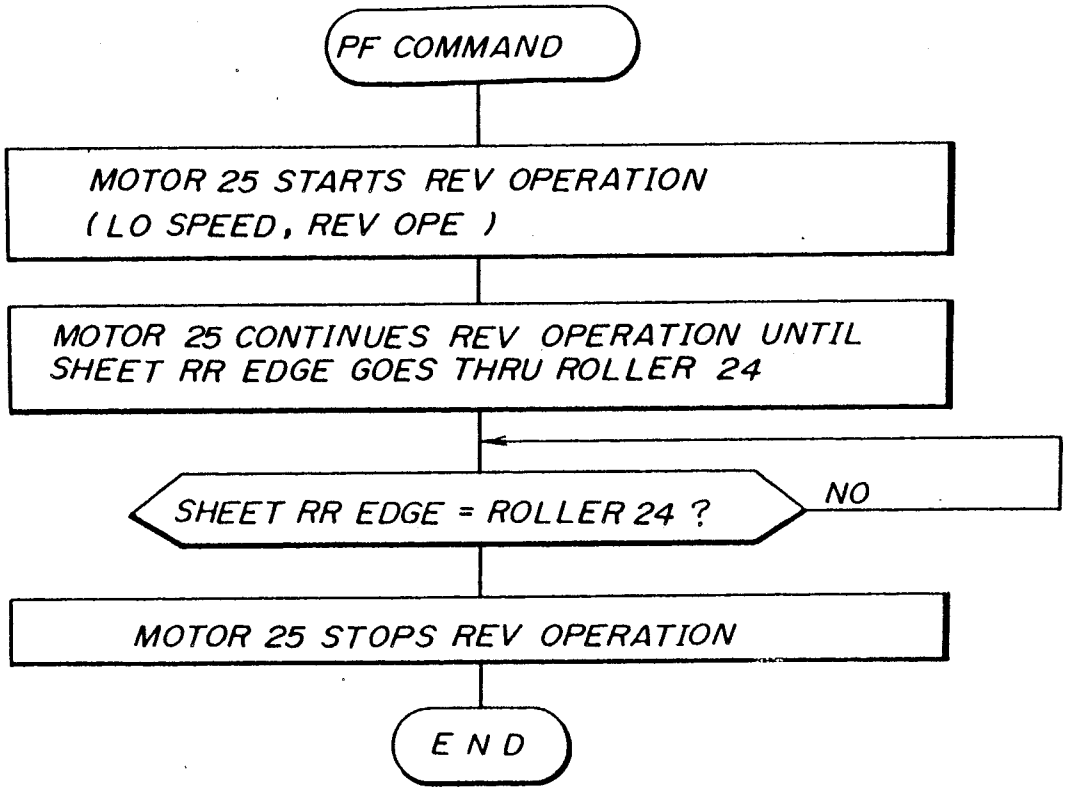
FIG. 5 is a flow chart showing the paper feed (PF) command processing in FIG. 3.
Figure 6:
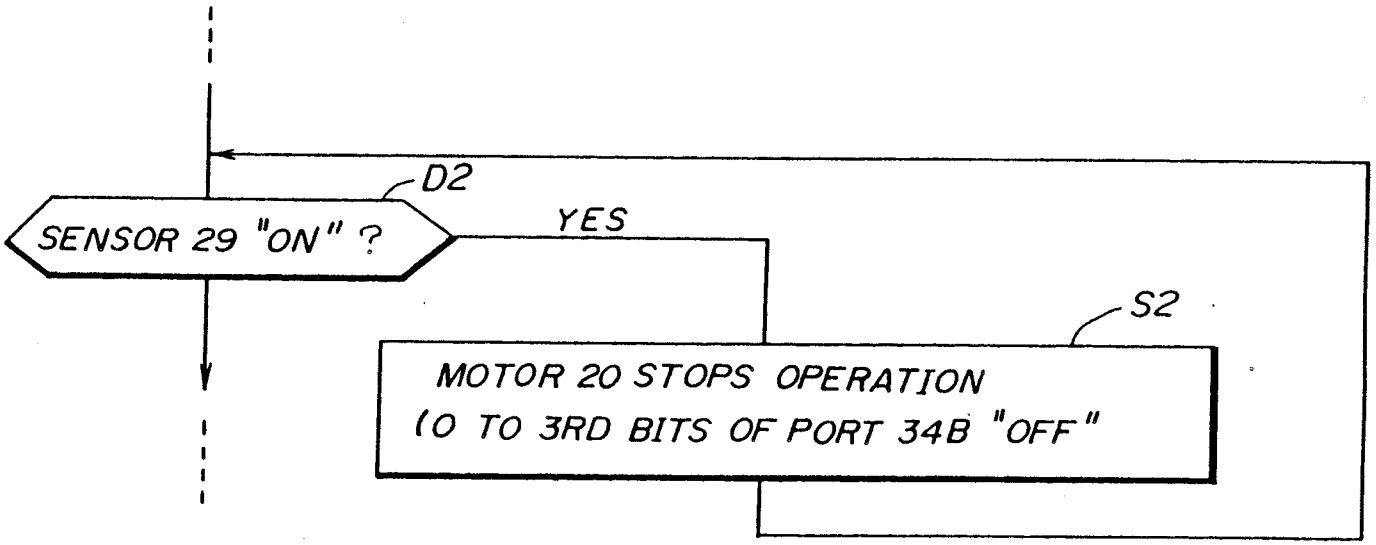
FIG. 6 is a flow chart used for an embodiment of the present invention in FIGS. 4A through 4D.

In this embodiment, the decision D1 and the step S1 as shown in FIG. 4B are changed to the decision D2 and the step S2 in FIG. 6. In the decision D1 in FIG. 4B, when the second drive motor 25 is being driven, the first drive motor 20 stops operation as in the step S1. Forward running of the first drive motor 20 is re-started as soon as the second motor 25 stops. In the decision D2 of FIG. 6, however, while the second paper sensor 29 is ON, the first drive motor stops and simultaneously when the second paper sensor 29 turns OFF the forward movement of the motor 20 is re-started. In other words, the second paper sensor 29 is turned OFF slightly earlier than the second drive motor 25 is turned off. This will described more clearly in the following when read in conjunction with FIGS. 7 through 9.

The paper feed and outlet routings by the PE and PF commands will be described below. In the processing of the PE command, there are two paper transport paths, one being the third paper outlet path 103 with a roller 32 and the other a first paper outlet path 101 with rollers 17 to 19. Which route of the two is selected is controlled by the printer control unit 35.

In the case of the PF command, there are three paper transport routes. Two of them are sheet transport paths 104 and 105 beginning from the upper and lower paper feeding cassettes 2 and 3, respectively. The last one is a second sheet transport path 102 beginning from the duplex recording apparatus 16. Similarly, which route of the three is selected is determined by the printer control unit 35.

Figure 7:
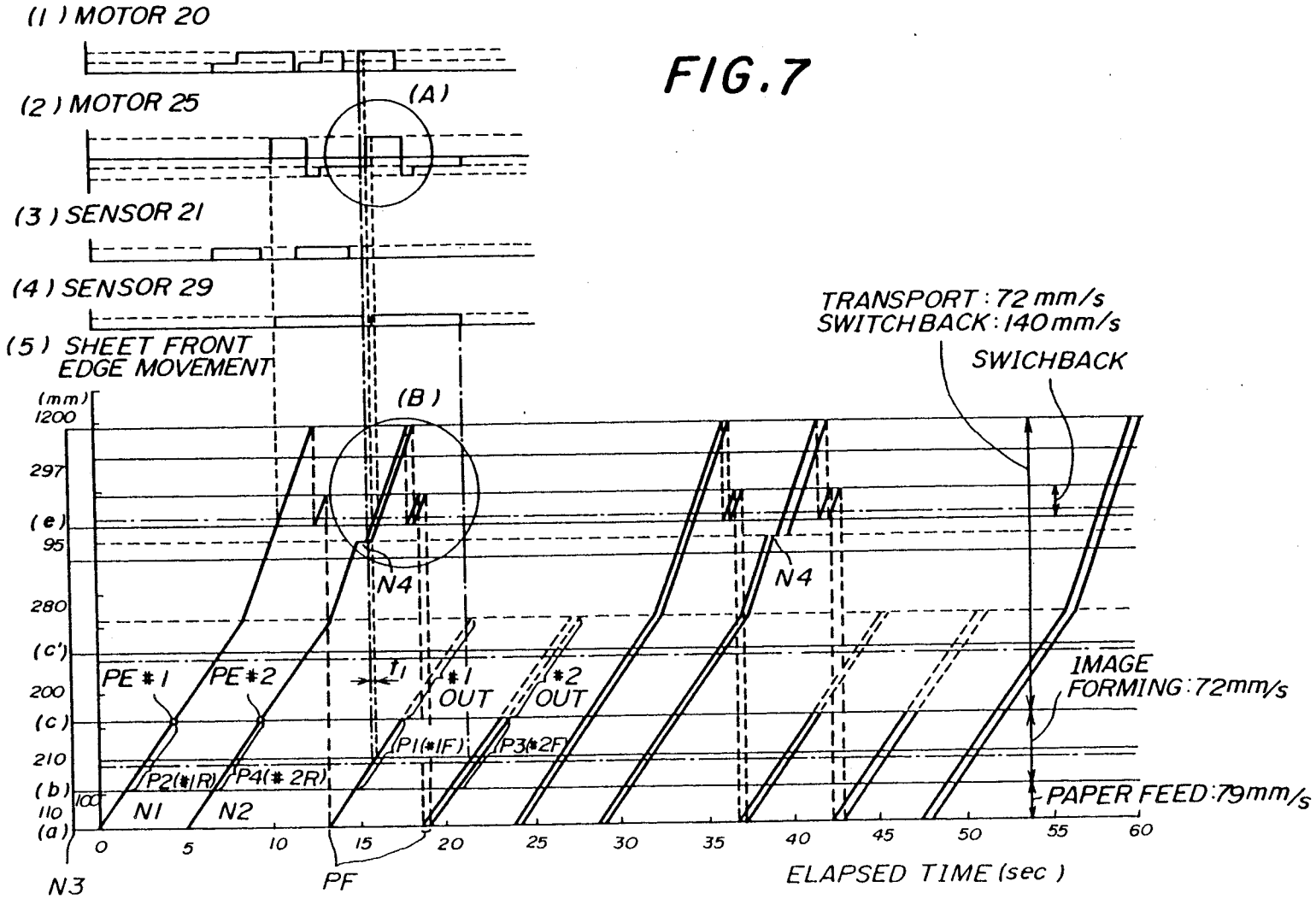
FIG. 7 is a timing chart used when the duplex recording of two sheets is carried out with this embodiment of the duplex recording apparatus.
Figure 8:
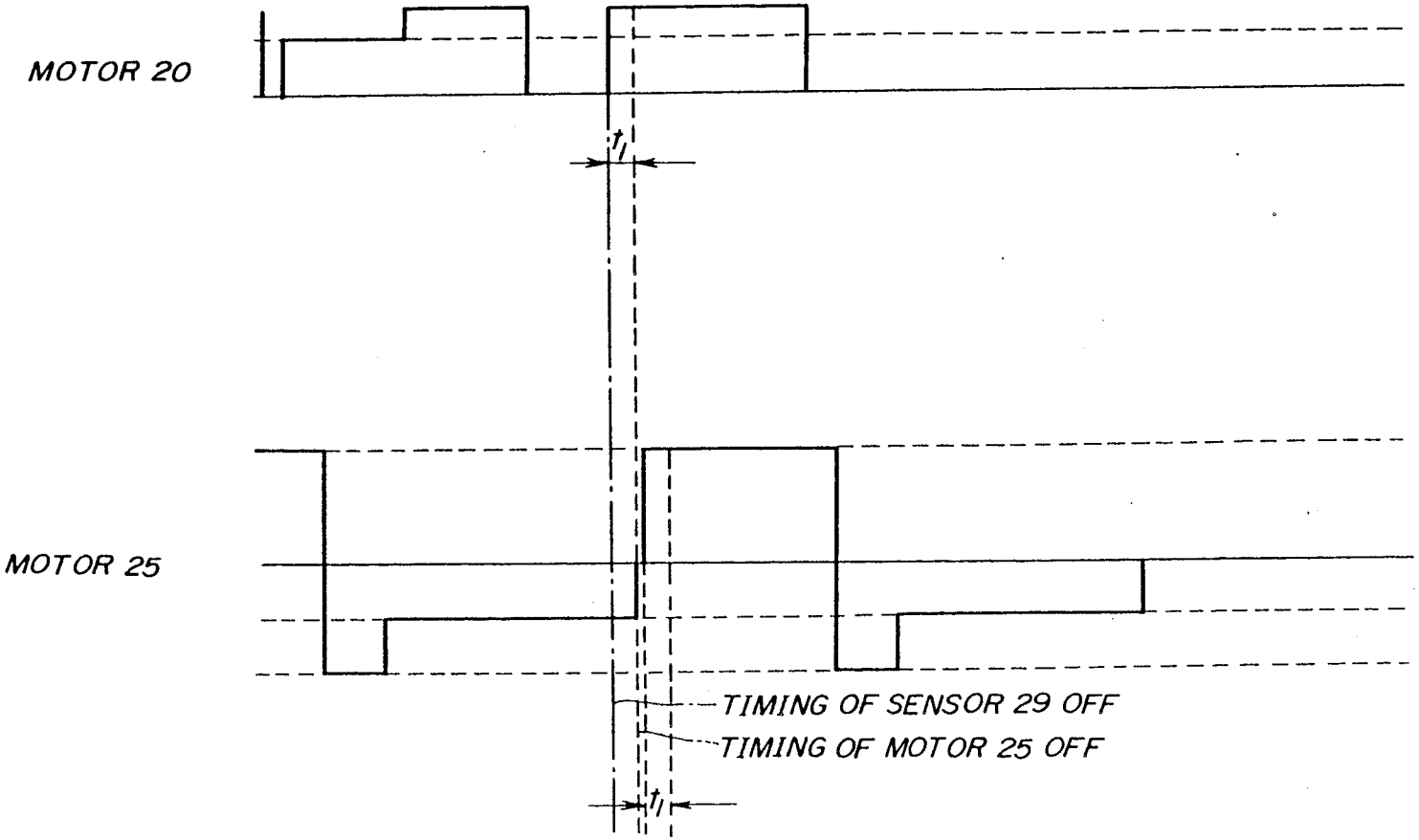
FIGS. 8 and 9 are enlarged diagrams showing the portions A and B indicated in FIG. 7.
Figure 9:
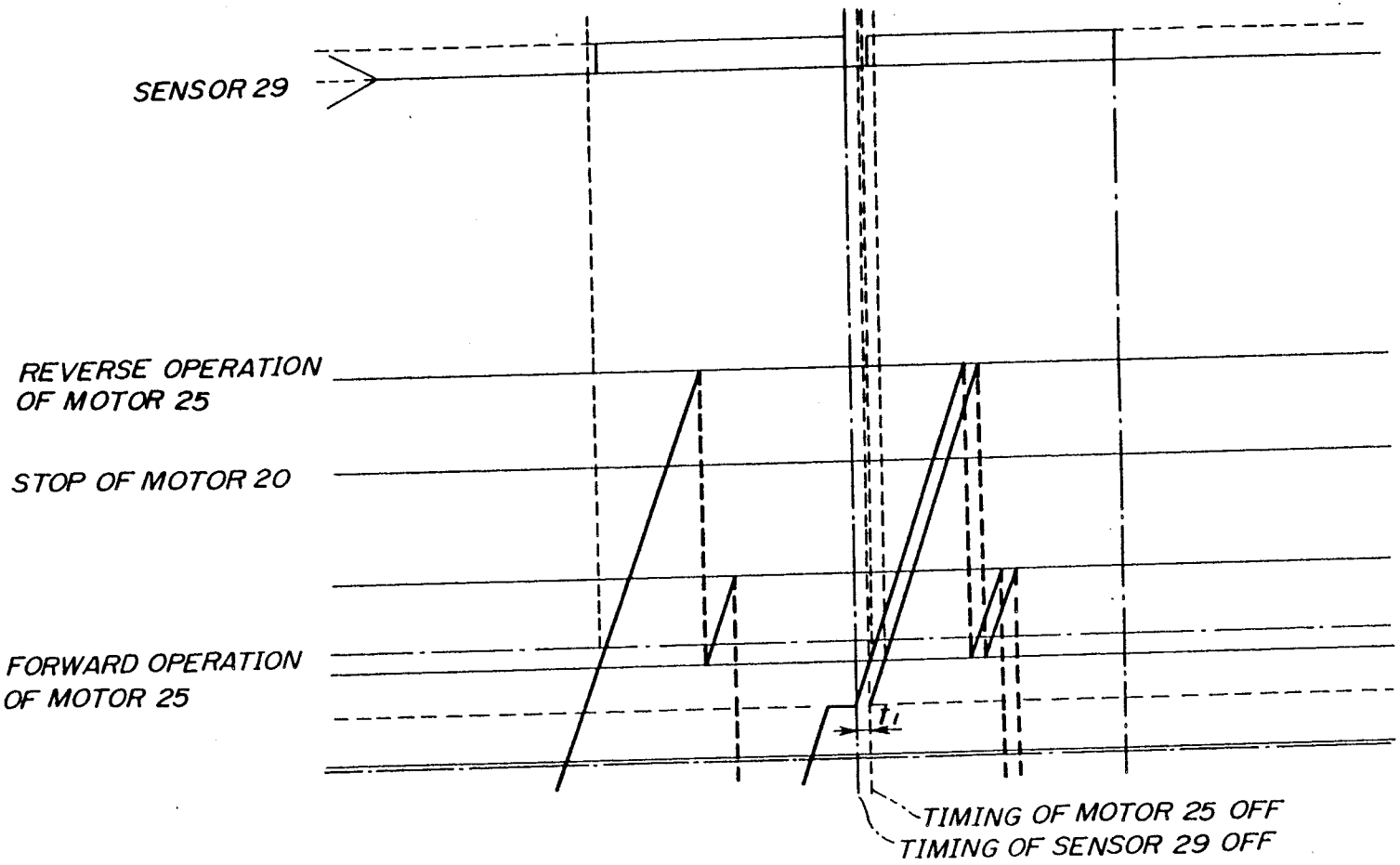

Description of the operation of this embodiment of the duplex recording sheet transport control apparatus will be described when read in conjunction with FIGS. 7 through 9. FIG. 7 is a timing chart, and FIGS. 8 and 9 are partial enlarged views of the portions A and B in FIG. 7.

FIG. 7 is a timing chart for explaining how the duplex printing of two sheets is carried out. In this figure, the ON/OFF timings of the first drive motor 20, the second drive motor 25, the first paper sensor 21 and the second paper sensor 29, relative to the elapsed time, are respectively shown in (1) through (4). And (5) of FIG. 7 shows the movement of an A4 type sheet front edge relative to the elapsed time. The execution of the PE command which carries out the supplying of the sheet from a printer 1 into the first paper transport path 101 is indicated by N1 in this figure. The execution of the PF command which carries out again the supplying from the switchback system 16B of duplex recording apparatus 16 to the printer 1 is indicated by N2. N3 indicates the second paper waiting position 31, and, in the case where sheets are supplied from an upper and lower paper feeding cassettes 2 and 3, it indicates the relative position of the pair of registration roller 7*b*. Note 4 indicates the waiting time interval of the second drive motor 25. The distances between major positions including the points (a) through (e) and the linear speed of sheets (transport speed) in the printer 1 and in the duplex recording apparatus are as follows.

| Distance Between Major Positions (mm) | Linear Speed (mm/sec) |
|---|---|
| (a) - (b): 100 | 79.2 |
| (b) - (c): 207 | 72.0 |
| (c) - (c'): 200 | 72.0 |
| (c') - (d): 280 | 72.0→140.0 |
| (d) - (e): 95 | 140.0 |
| (e) - (a): 90 | 140.0 |

Where:

(a)=second paper waiting position 31

(b)=center of registration rollers 7 of printer (c)=center of paper outlet rollers 32 of printer (c')=center of first transport rollers 17

(d)=center of third transport rollers 19

(e)=center of switchback drive rollers 24

For example, with the printing speed for the standard specification being set to 12 PPM (pages per minute), the linear speed at the image forming portion is 72 mm/s, the paper feed distance 63 mm and the time interval between A4 paper feeds 5 sec (mm).

As shown in FIG. 7, the PE command is executed for the second sheet (P4: #2 reverse). And at the point (d) indicated by N4, when staying at the first paper waiting position 30 the sheet is waiting for the second drive motor 25 becoming open, the second paper sensor 29 is turned OFF earlier than the timing of turning the motor 25's drive signal OFF, as early as a time period t1 indicated in FIGS. 8 and 9. (Refer to the decision D2 in FIG. 6). As a result, the end of the second sheet is detected, and the CPU 34 instructs to re-start the forward operation of the first drive motor 20 the time period t1 before the motor 25 is turned OFF, and the PF command for the #1 sheet at the first waiting position is also executed the time period t1 before the motor 25 is turned OFF to achieve a shorter paper feed time interval. The second drive motor 25 is turned OFF after the second paper sensor 29 is turned ON.

Figure 10:
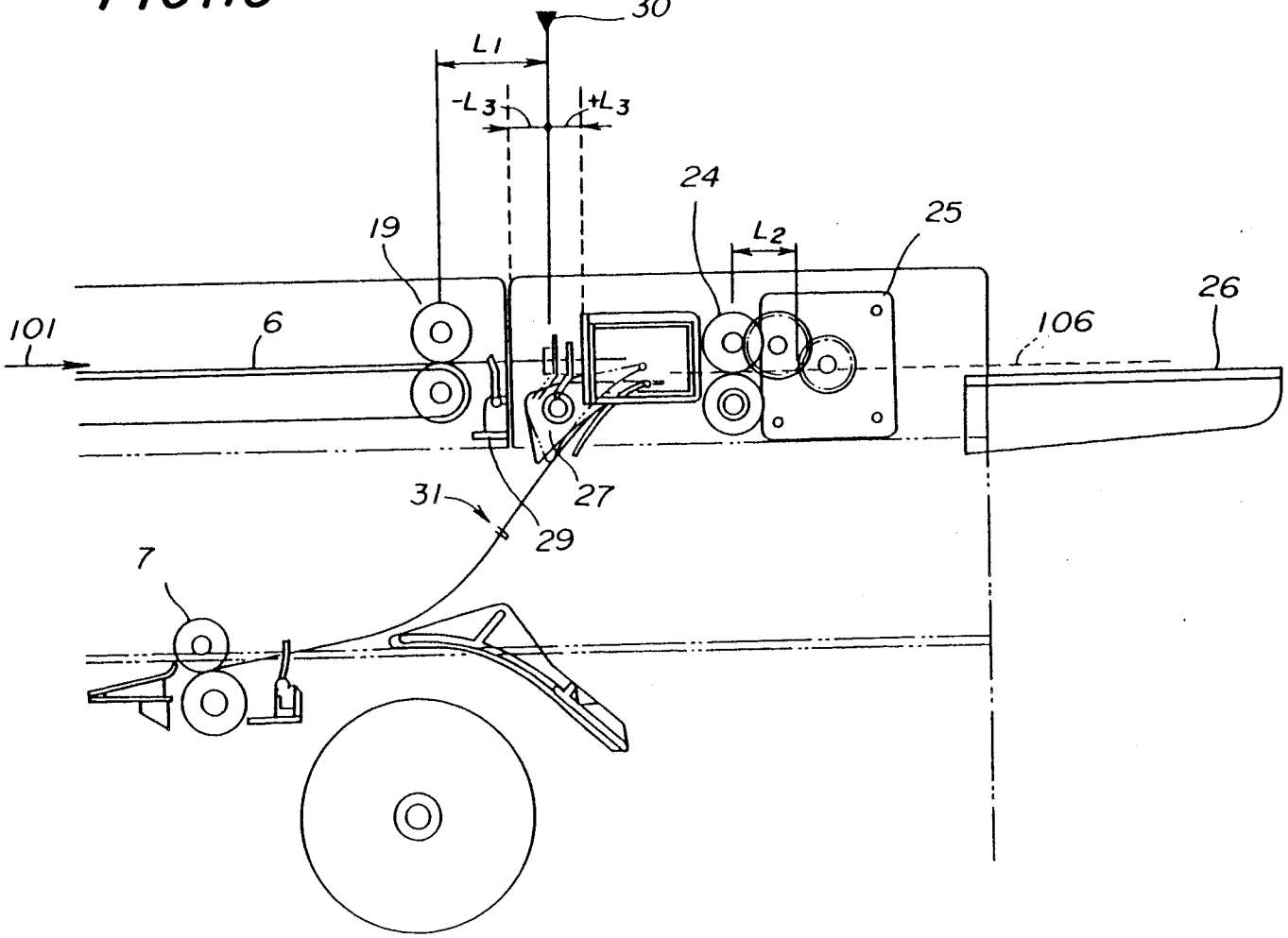
FIG. 10 is a schematic view showing an embodiment of a switchback system of the duplex recording apparatus according to this invention.

Referring to FIGS. 10 through 20, another embodiment of the duplex recording sheet transport control apparatus according to the present invention is described. FIG. 10 is a schematic view of the switchback system 16B of the duplex recording apparatus. As shown in this figure, the second paper sensor 29 is provided at a position above the paper transport path which is separate by a predetermined distance from the first waiting position 30. This position 30 is separated by a standard distance L1 from the center of the third transport roller 19 and is located below the forward transport path. The first paper waiting position 30 is adjustable within the range of distance (±L3).

Figure 11:
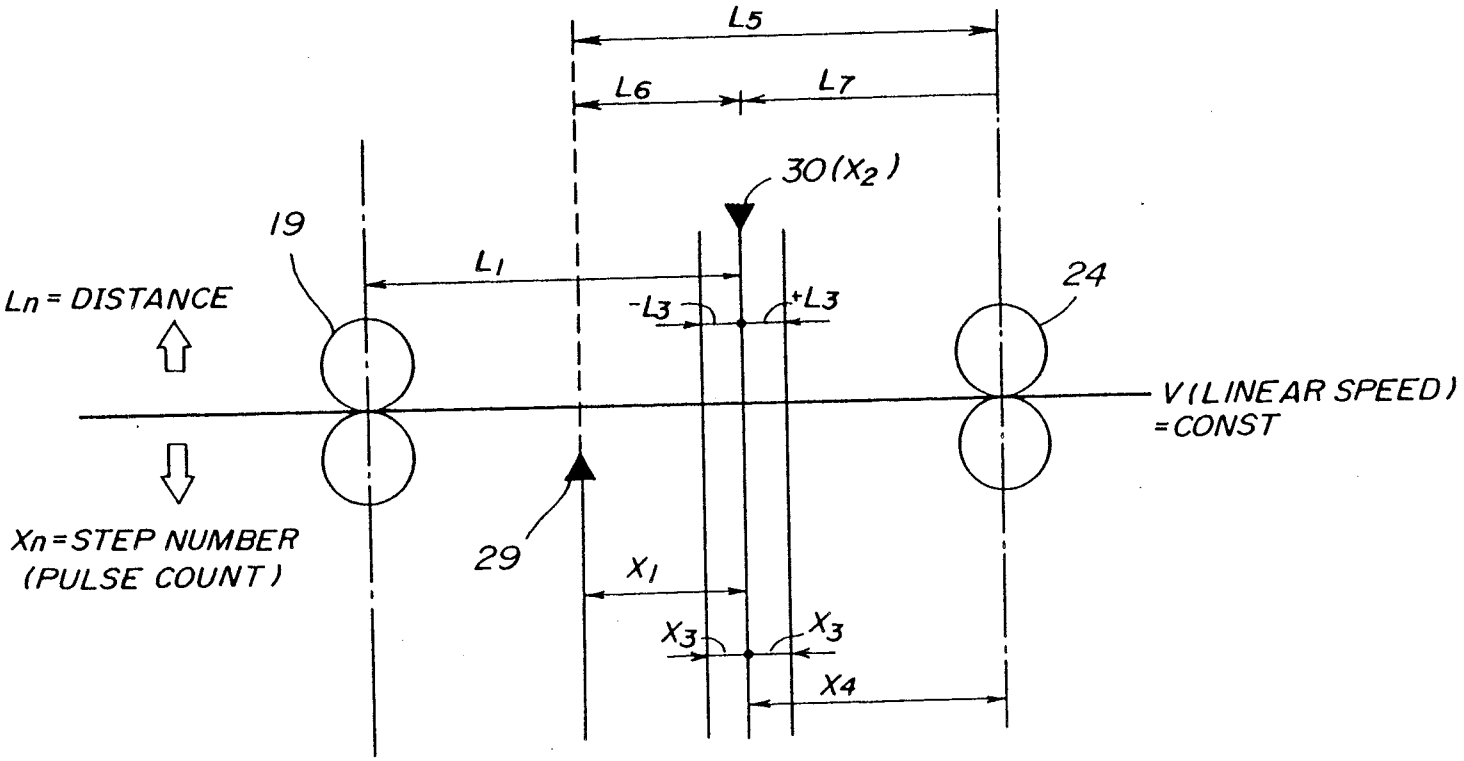
FIG. 11 is a diagram for explaining how the first paper waiting position 30 shown in FIG. 10 is made adjustable.

FIG. 11 is a diagram for explaining the operation of the apparatus for making the first waiting position 30 variable. In this figure, L1 is a standard length corresponding to a distance from the center of the third transport roller 19 to the first waiting position 30, L5 is a distance from the center of the switchback drive roller 24 to the second paper sensor 29 provided below the forward transport path of the third transport roller 19, L6 is a distance from the second paper sensor 29 to the position 30 which is adjusted, and L7 is a distance from the center of the switchback drive roller 24 to the position 30 which is adjusted. The first waiting position 30 when adjusted to a position below or above the forward transport path is located at a distance of plus or minus L3. And X1 in this figure indicates the number of counts of drive pulses sent to the first drive motor 20, starting from the time when the second paper sensor 29 turns ON, X2 is a predetermined standard value for the waiting position counts which is previously stored in the ROM 34E of the CPU 34 (see FIG. 12), and X3 is the adjustment value for increasing or decreasing said standard value X2 for the waiting position (stored in RAM 34F shown in FIG. 12). This adjustment value is that corresponding to the adjustment distance L3. The X4 for the distance between the first paper waiting position 30 and the center of switchback drive roller 24 is the count determined from the formula (4) below.

The distances L6 and L7 are expressed as follows, where the sheet transport speed (linear speed) V is constant, f is the drive pulse rate of the first drive motor 20, tx1 is the transport time required for the distance L6, and tx4 is the transport time required for the distance L7:

$$L6 = Vt \times 1 = (V/f)\ X1 \quad (1)$$

$$L7 = Vt \times 4 = (V/f)\ X4 \quad (2)$$

Substituting these formulas (1) and (2) into L7=L5−L6 makes $$(V/f)\ X4 = L5 - (V/f)\ X1 \quad (3)$$

Therefore, $$X4 = (L5\ f)/V - X1 = (L5\ f)/V - (X2 \pm X3) \quad (4)$$

$$X1 = X2 \pm X3$$

And, from the above formulas (2) and (4)

$$t \times 4 = (L5/V) - (X2 \pm X3) \quad (4)'$$

By varying the waiting position count X2 of the standard value with the adjustment value (±X3), the first waiting position 30 is made adjustable within the distance range (±L3) corresponding to the adjustment value.

When the reversing of the first sheet (the #2 paper feed) is ended, the second sheet is transported from the first waiting position 30 to the switchback system 16B of the duplex recording apparatus. As readily understood from the above formula (4)', the timing of the re-starting of the second drive motor 25's forward operation becomes earlier as the first paper waiting position 30 is located nearer to the switchback drive motor 24.

In other words, it is possible to produce the earliest re-start timing of the second drive motor 25's forward operation when the distance is equal to (L1+L3), and the latest timing with the distance equal to (L1−L3). By adjusting the adjustment value (±X3) relative to the waiting position count X2, it is possible to make the start timing of the second drive motor 25 adjustable.

When X3=0, t1 and t4 indicate the start timing of second drive motor 25 operation and the timing of PF command execution respectively, and t3 indicates the sheet transport time required for the distance L3. If the increment of (+X3) is set for the waiting position count X2, the starting of second drive motor 25 operation and the execution of PF command from the second paper waiting position 31 are made respectively at the timings of (t1− t3) and (t4−t3). And, if the decrement of (−X3) is set for the waiting position count X2, the starting of the motor 25 operation and the execution of the PF command are made respectively at the timings of (t1+t3) and (t4+t3). As in the foregoing, varying the execution timing of PF command allows adjustment of duplex recording sheet transport speed when the duplex recording apparatus is used.

Figure 12:
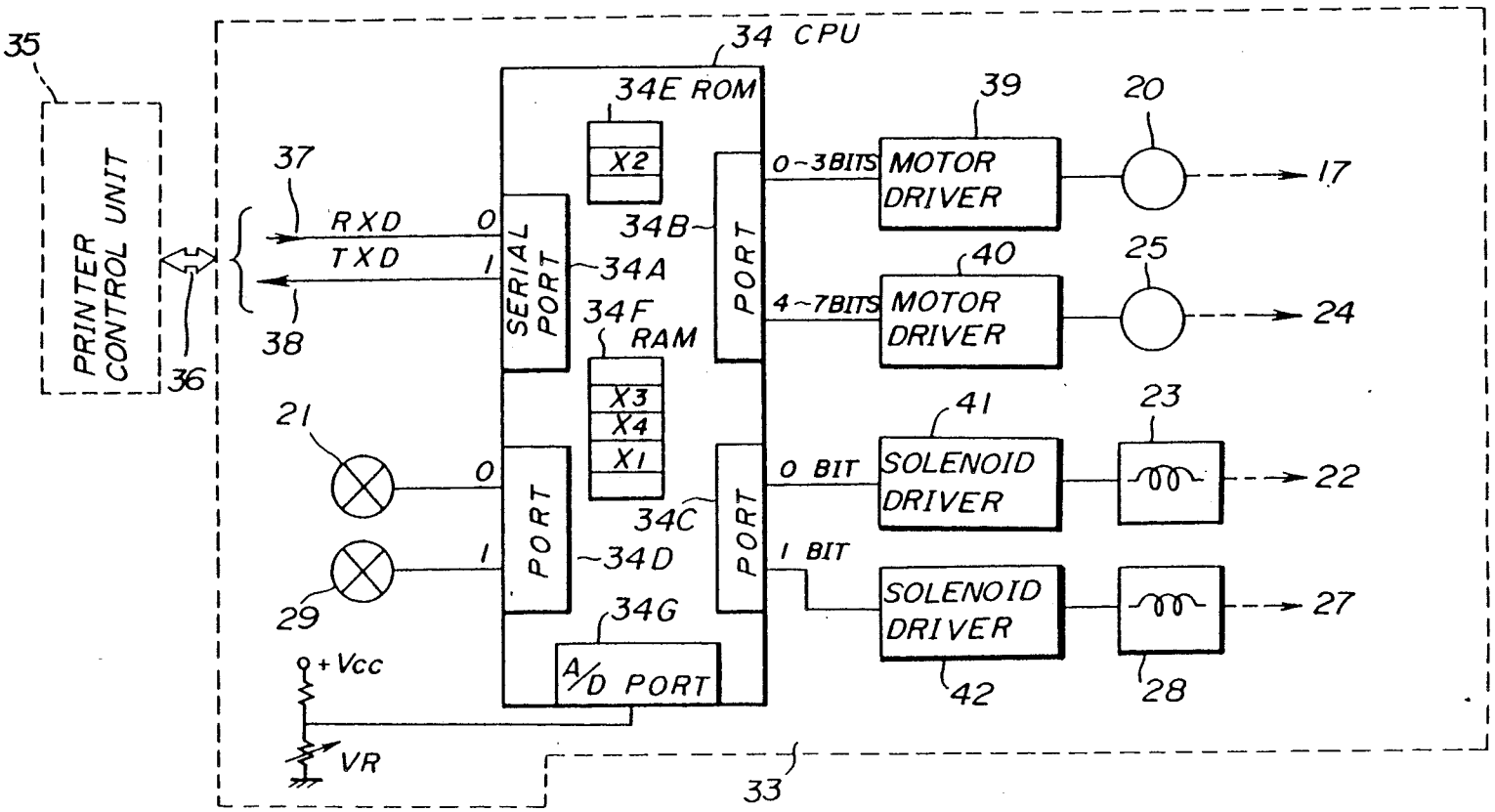
FIG. 12 is a system block diagram showing an embodiment of the control unit of the duplex recording apparatus according to the invention.

FIG. 12 is a block diagram of the embodiment of the control unit 33 of the duplex recording apparatus according to the invention. To avoid repetition, the description of the functional portions similar to those of FIG. 2 is omitted, and the description of only the different parts is given in the following.

The ROM 34E in the CPU 34 stores the object code of the program for the control unit 33 of the duplex recording apparatus as well as a predetermined value of the position count X2 for the first waiting position 30. Stored in the RAM 34F are an adjustment value X3 for the waiting position count X2, a drive pulse count X4 necessary for the first drive motor 20 to transport the sheet from the position 30 to the roller 24, and a drive pulse count X1 for the motor 20 to start operation after the sensor 29 senses the sheet front edge and stops running at the first waiting position. The above described adjustment value X3 is obtained by applying the voltage across a variable resistor VR for adjustment use (not shown) to the A/D port 34G to subject the voltage to an A/D conversion.

Figure 13:
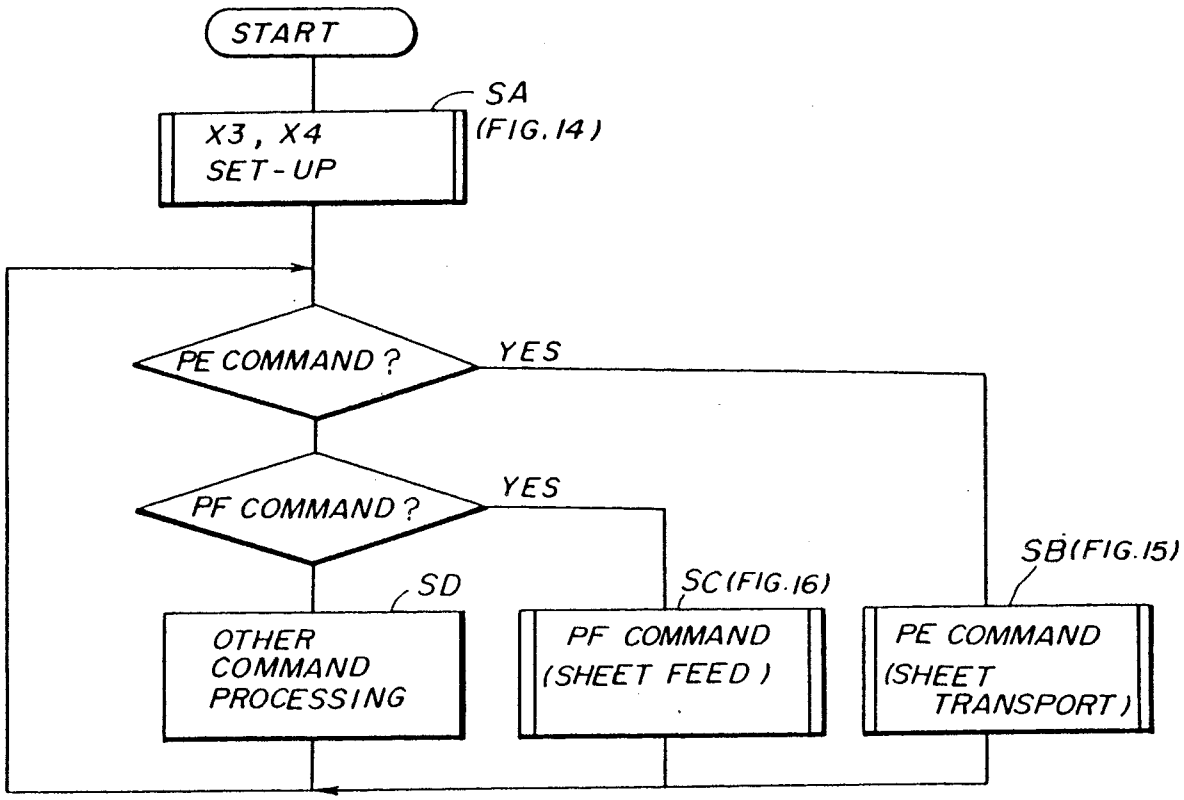
FIG. 13 is an overall flow chart used for this control unit of duplex recording apparatus.

FIG. 13 is an overall flow chart of the present embodiment of control unit 33 for the duplex recording apparatus. The setup processing of the adjustment value (X3) and the drive pulse count (X4) for the first drive motor 20 is first made in the step SA. (For detail see FIG. 14) The decisions for paper eject (PE) command and paper feed (PF) command are then made to determine if the next step is the PE command step SB (see FIG. 15 for detail of the paper transport processing) or the PF command step SC (see FIG. 16 for detail of the paper feed processing) or other command step SB. If the next step is not the PE command or PF command, the other command step is taken.

Figure 14:
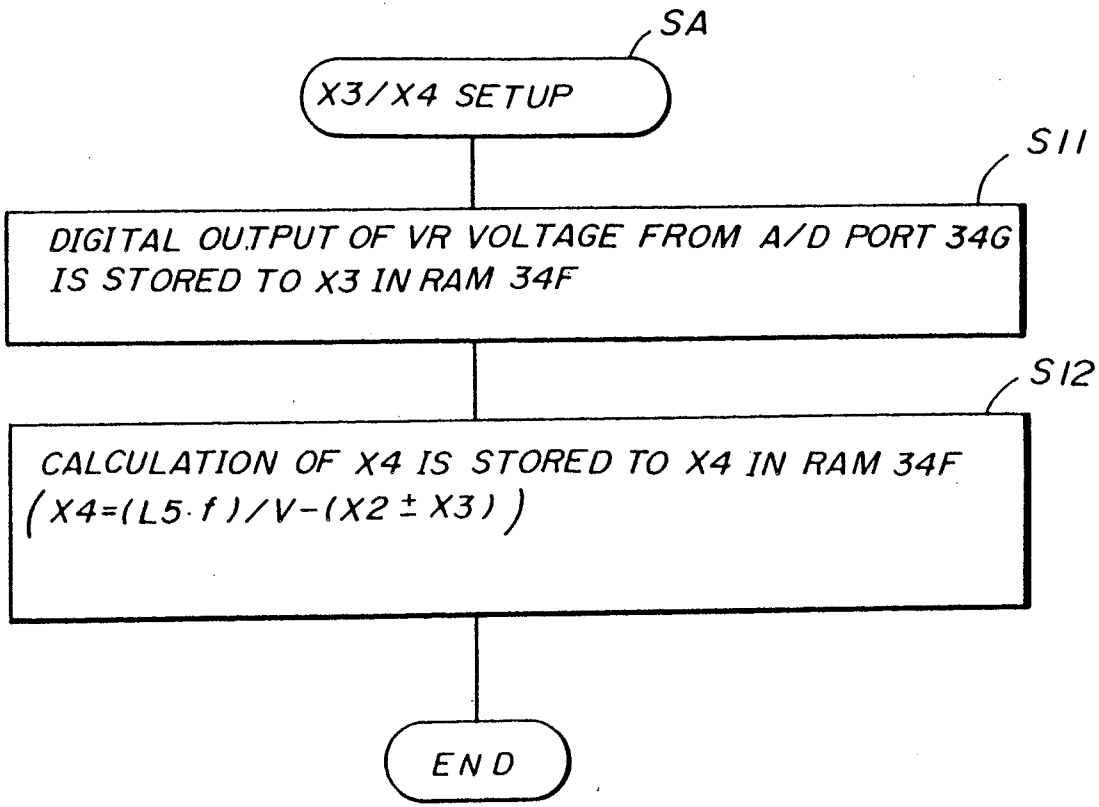
FIG. 14 is a flow chart showing a step SA for setting up the X3 and X4 in FIG. 13.
Figure 15A:
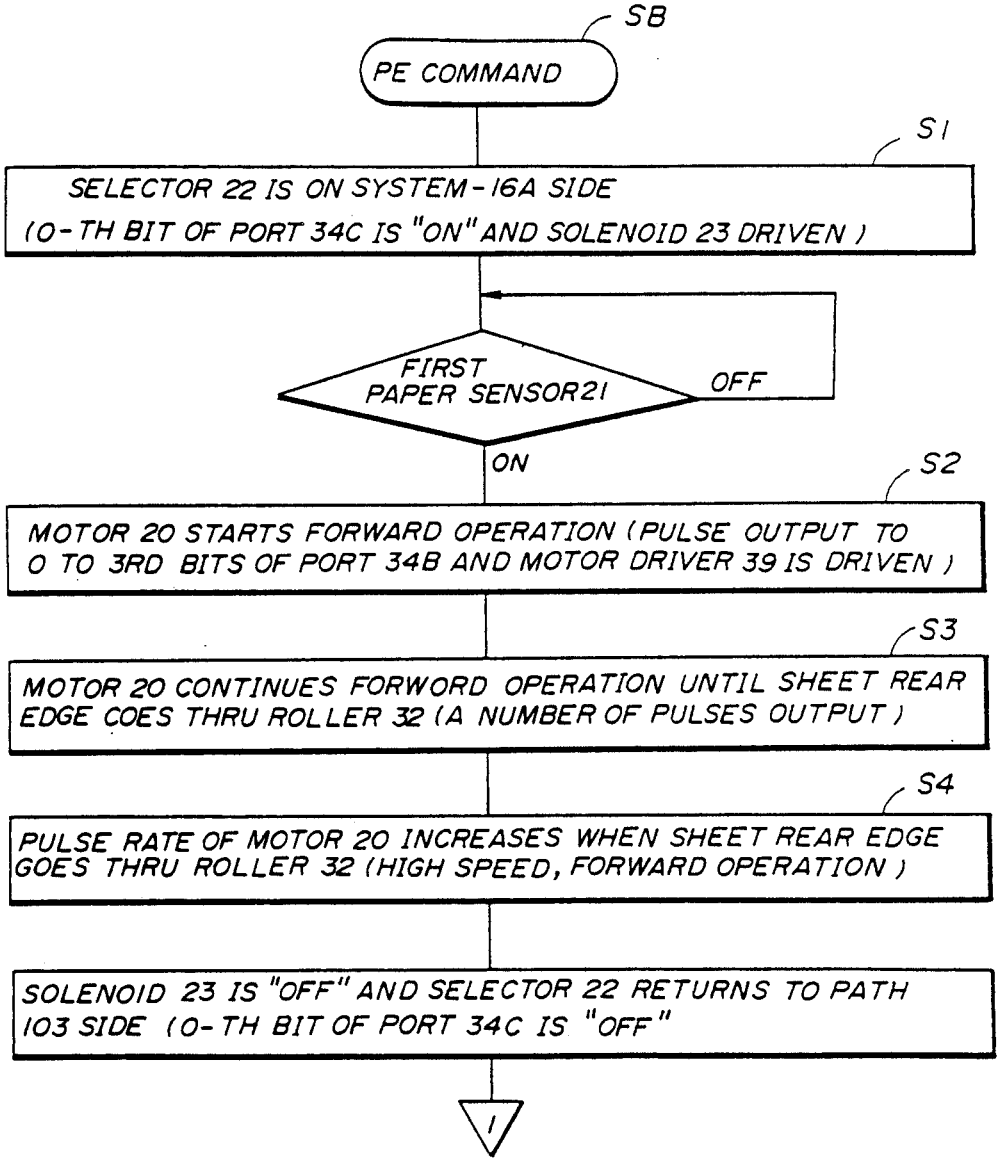
FIG. 15A through 15E are a flow chart showing the paper eject (PE) command processing in FIG. 13.
Figure 15B:
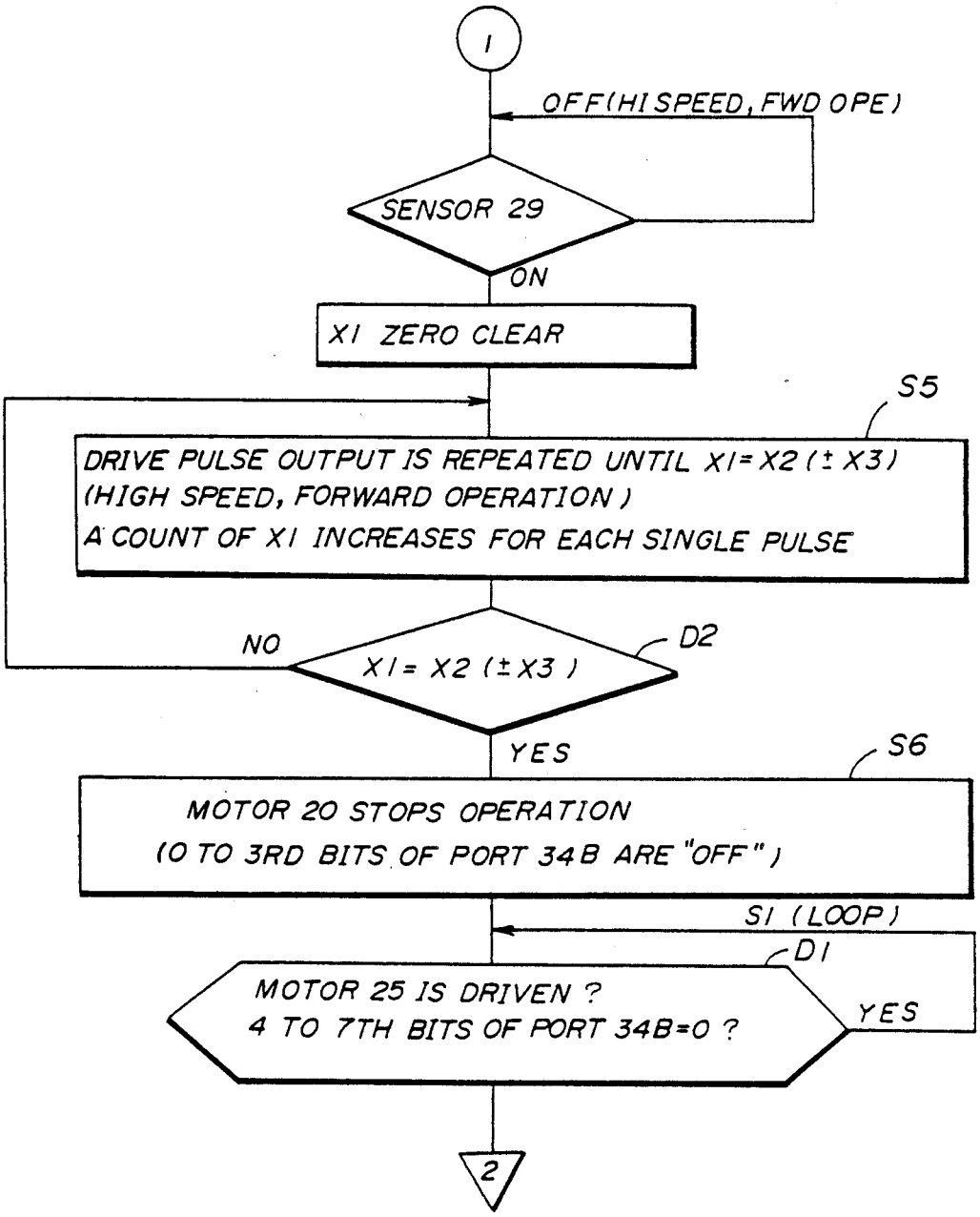
Figure 15C:
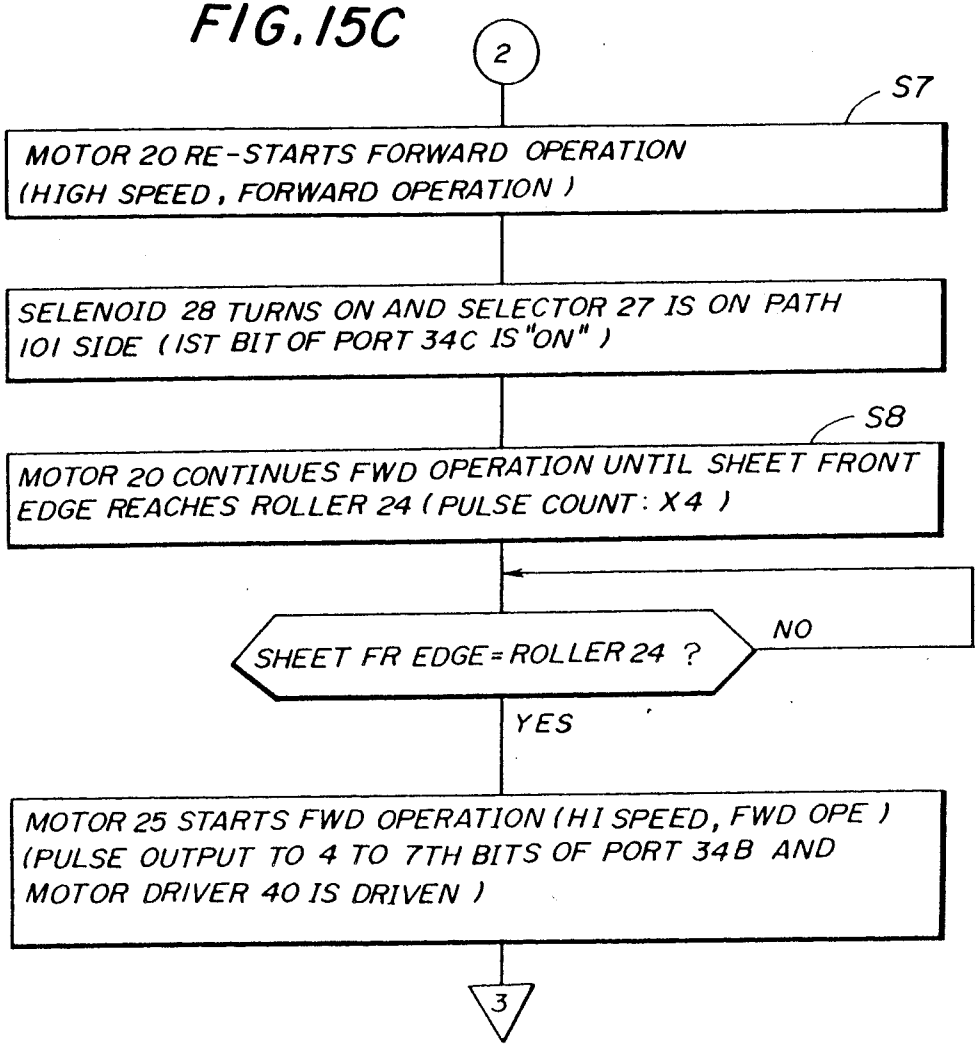
Figure 15D:
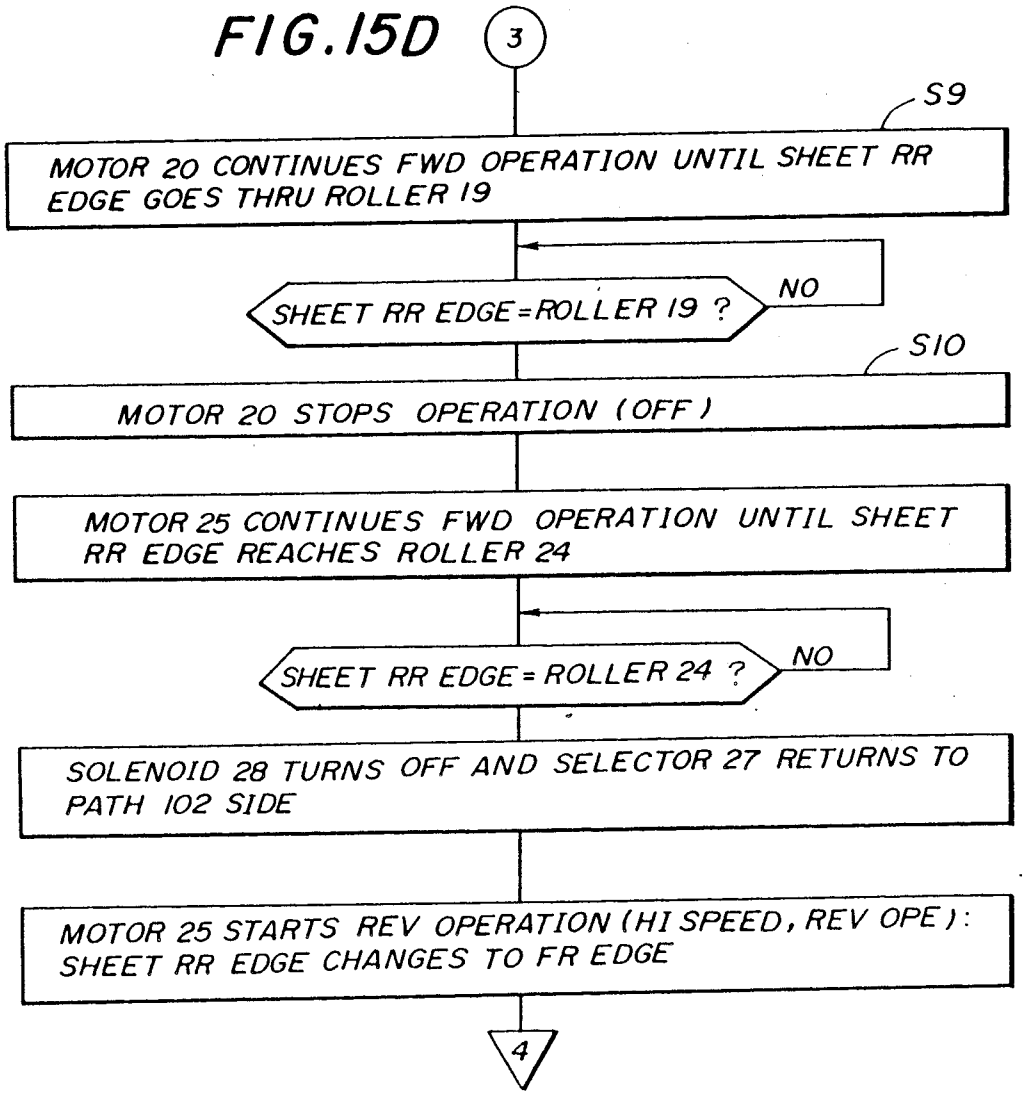
Figure 15E:
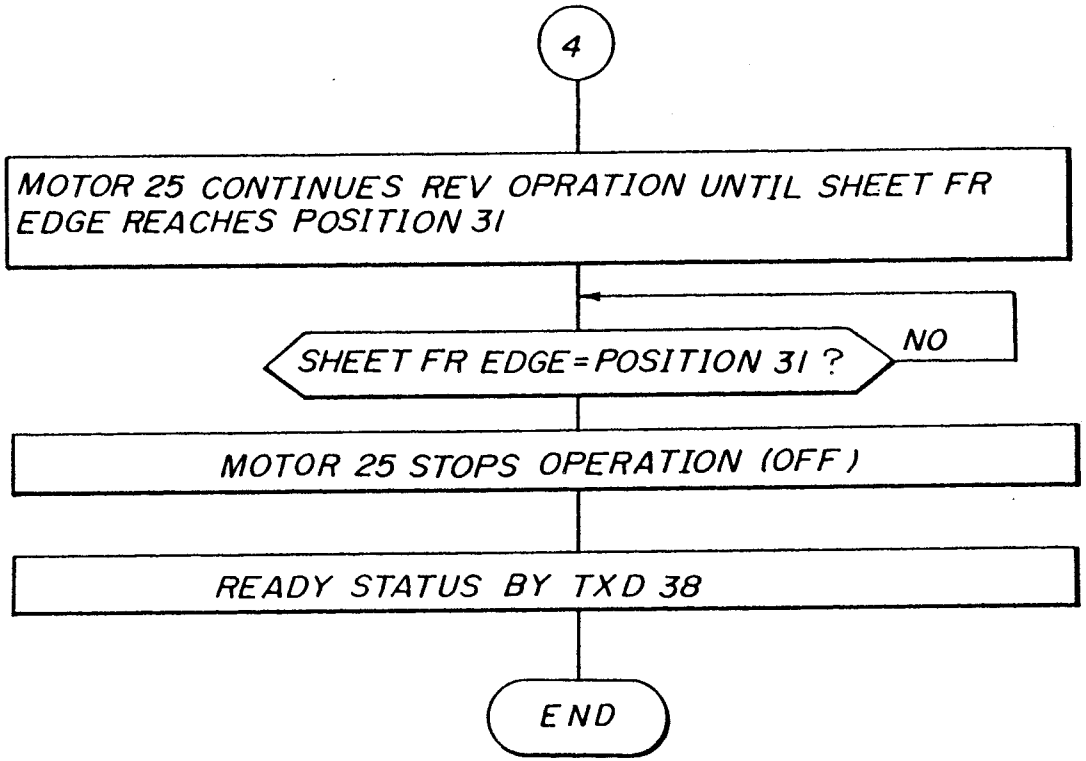

FIG. 14 is a flow chart of setting up the adjustment value (X3) and the drive pulse count (PE) in the present embodiment. In the X3/X4 setup, the step S11 is that the input voltage for a variable resistor VR given to the A/D port 34G is converted as an digital output to be stored at the X3 in the RAM 34F. And in the step S12, the value of X4 is calculated according to the above formula (4) and the calculation is stored at the X4 in the RAM 34F. In the decision D1 and the step S1 shown in FIG. 15, the timing of waiting for the second drive motor 25 becoming open is determined. The drive pulse count X1 to the first drive motor 20 is processed in the decision D2 and the step S2. The OFF timing of the first drive motor 20 is controlled with a predetermined value of adjustment count (±X3) to the waiting position count (X2) for the first waiting position 30.

A description of the paper supply and outlet paths will be given in relation with the PE command and the PF command in the following. In the PE command, the third paper outlet path 103 leading to the paper outlet roller 32 of the printer and the paper outlet path 101 leading to the first through third transport rollers 17 through 19 are related. The path which is selected is controlled by the contol unit 35 of the printer.

In the PF command, the paper transport paths 4 and 5 from the upper and lower paper feeding cassettes 2 and 3 of the printer and the second paper transport path 2 from the duplex recording apparatus are related. Similarly, the selection of paper transport paths is determined by the control unit of the printer.

Figure 16:
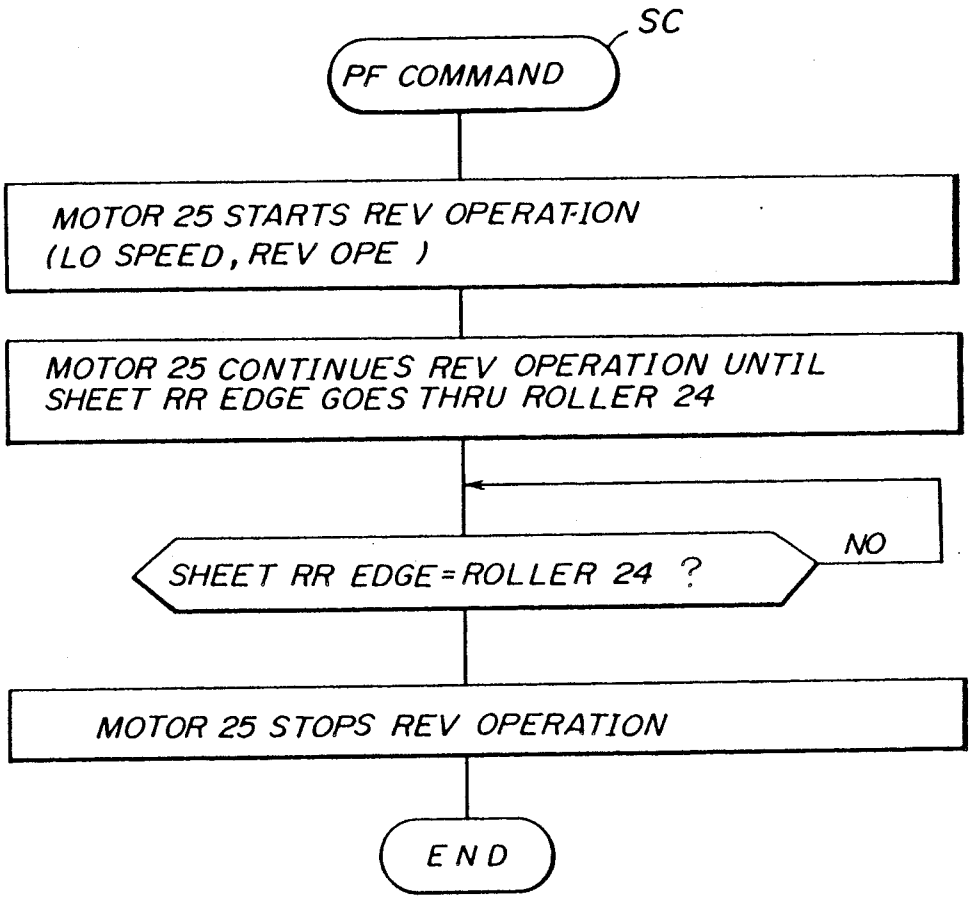
FIG. 16 is a flow chart showing the paper feed (PF) command processing in FIG. 13.
Figure 17:
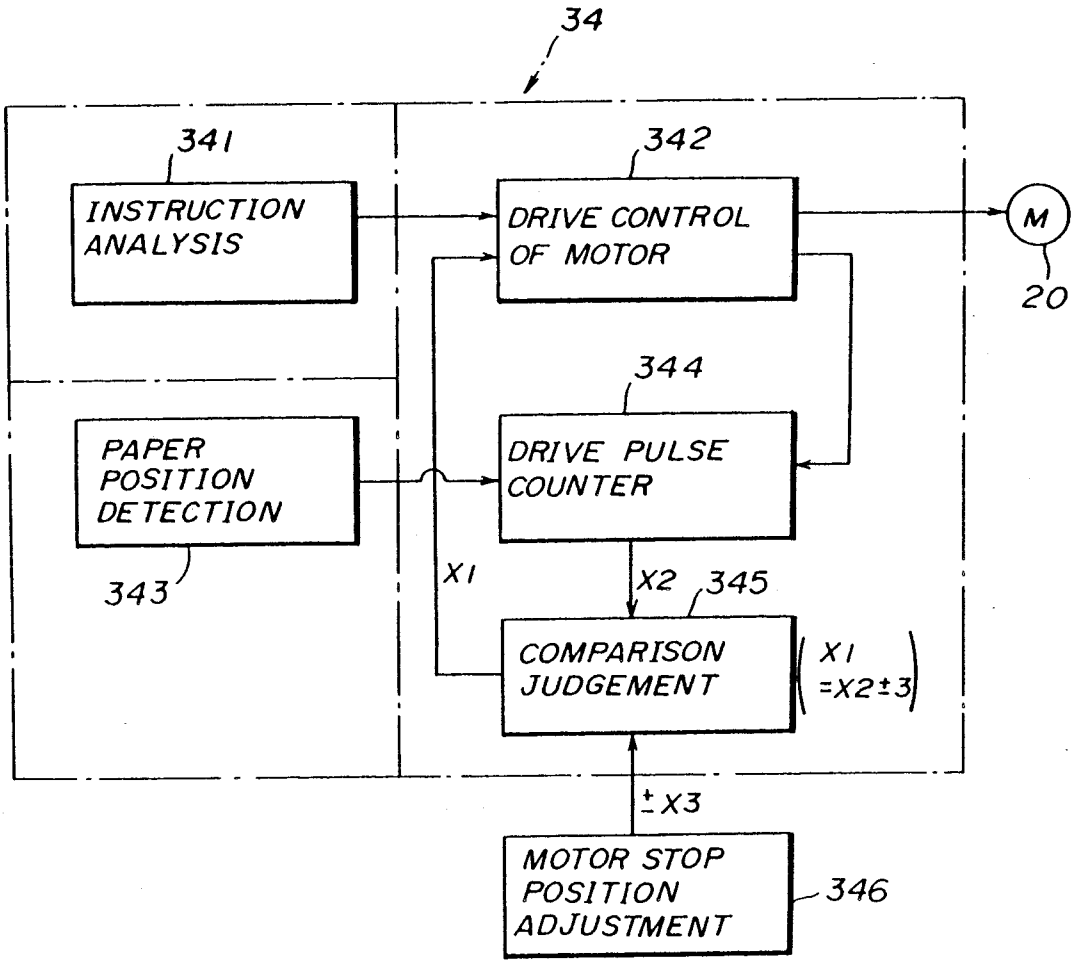
FIG. 17 is a control block diagram used for carrying out the adjustment of the first paper waiting position.

FIG. 17 is a control block diagram for adjustment of the varying positions for the first paper waiting position. The decisions and steps in the flow charts in FIGS. 14 through 16 are related to this part. In this figure, the instruction analysis block 341 is to execute the analyses for the instructions of PE and PF commands in FIGS. 15 and 16 and to give input to the drive control block 342 for the first drive motor 20 (the motor driver 39 in FIG. 12 and the steps S1 through S10). The paper position detection block 343 is equivalent to that with the second paper sensor 29, and the detection results in this block are given to the drive pulse counter 344. This pulse counter block is equivalent to the step S5 in FIG. 15, and the counting of drive pulses from the drive control part 342 to the first drive motor 20 is repeated until X1 is equal to X2 (±X3). The comparison judgment part 345 is equivalent to the decision D2 in FIG. 15, and in this block the comparison as to whether the X1 is equal to X2 (±X3) is made using the output X2 of the drive pulse counter 344 and the adjustment value (±X3) from the motor stop position adjustment block 346. The block 346 adjusts the motor stop position of the first drive motor 20, and is equivalent to the step S11 in FIG. 14, and the adjustment value (±X3) related to the variable resistor VR is stored in the RAM 34F and the output is given to the block 345.

The execution for the drive pulse counter block 344 and the comparison judgment block 345 is carried out according to the program stored in the ROM 34E of the CPU 34.

Figure 19:
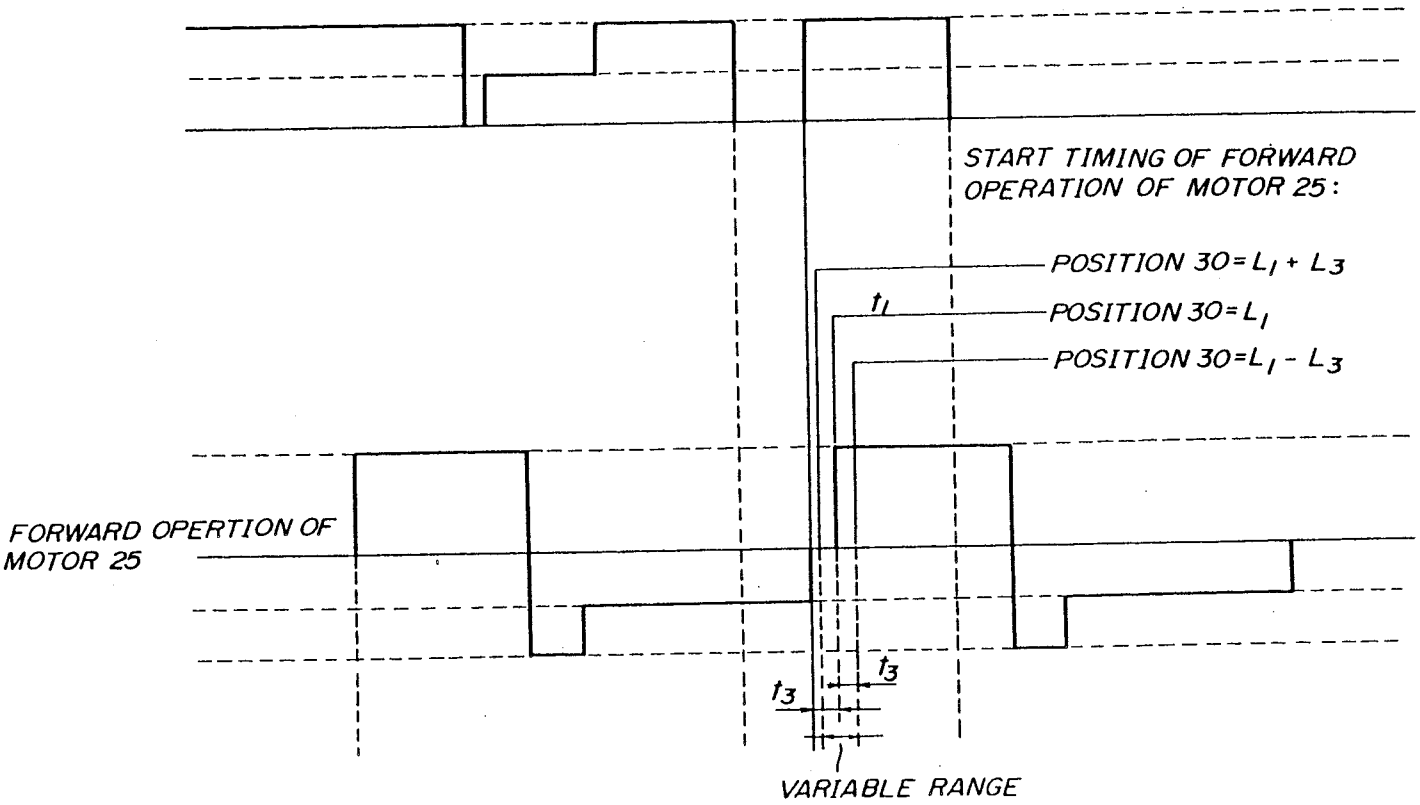
FIGS. 19 and 20 are enlarged diagrams showing the portions A and B indicated in FIG. 18.
Figure 20:
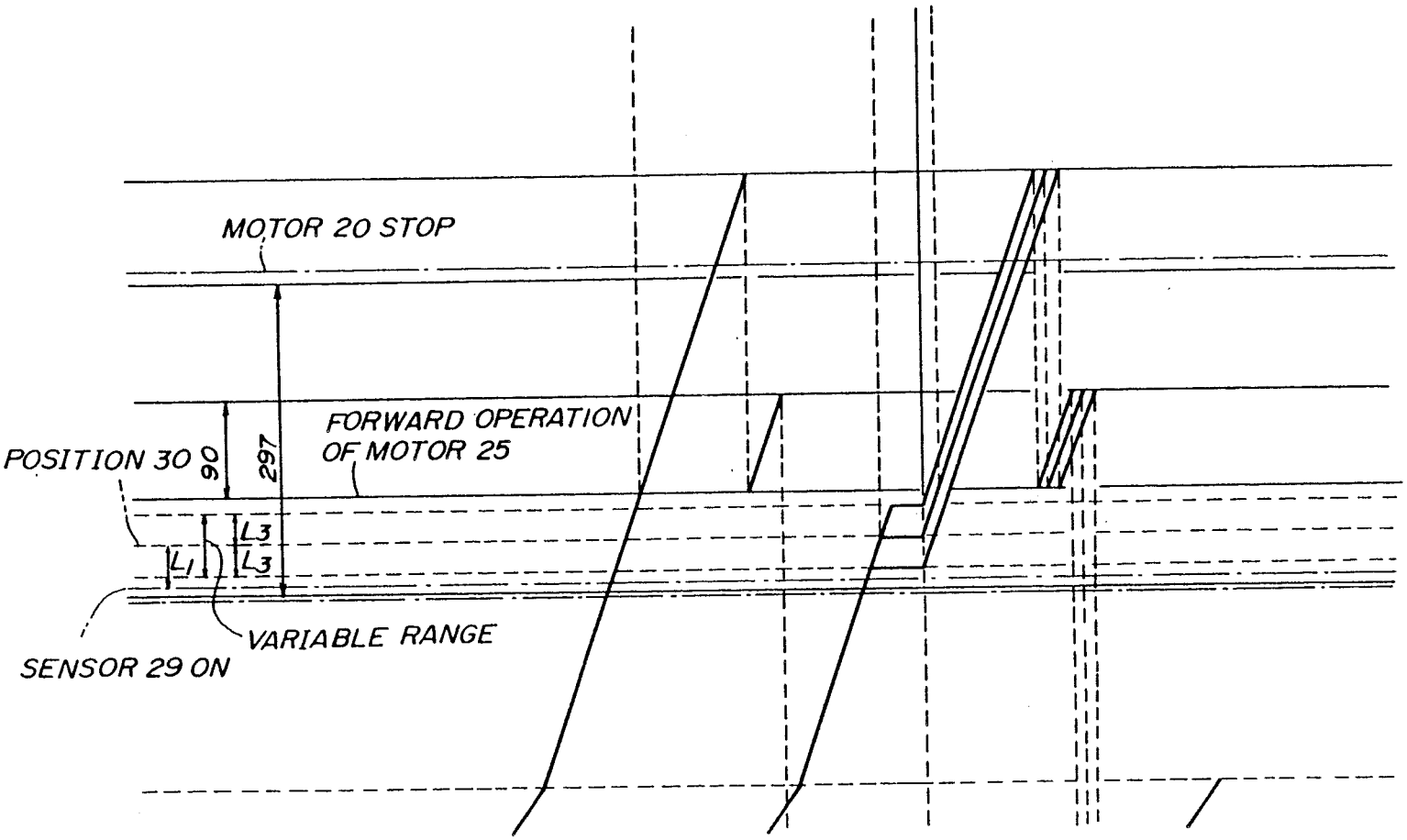
Figure 21:
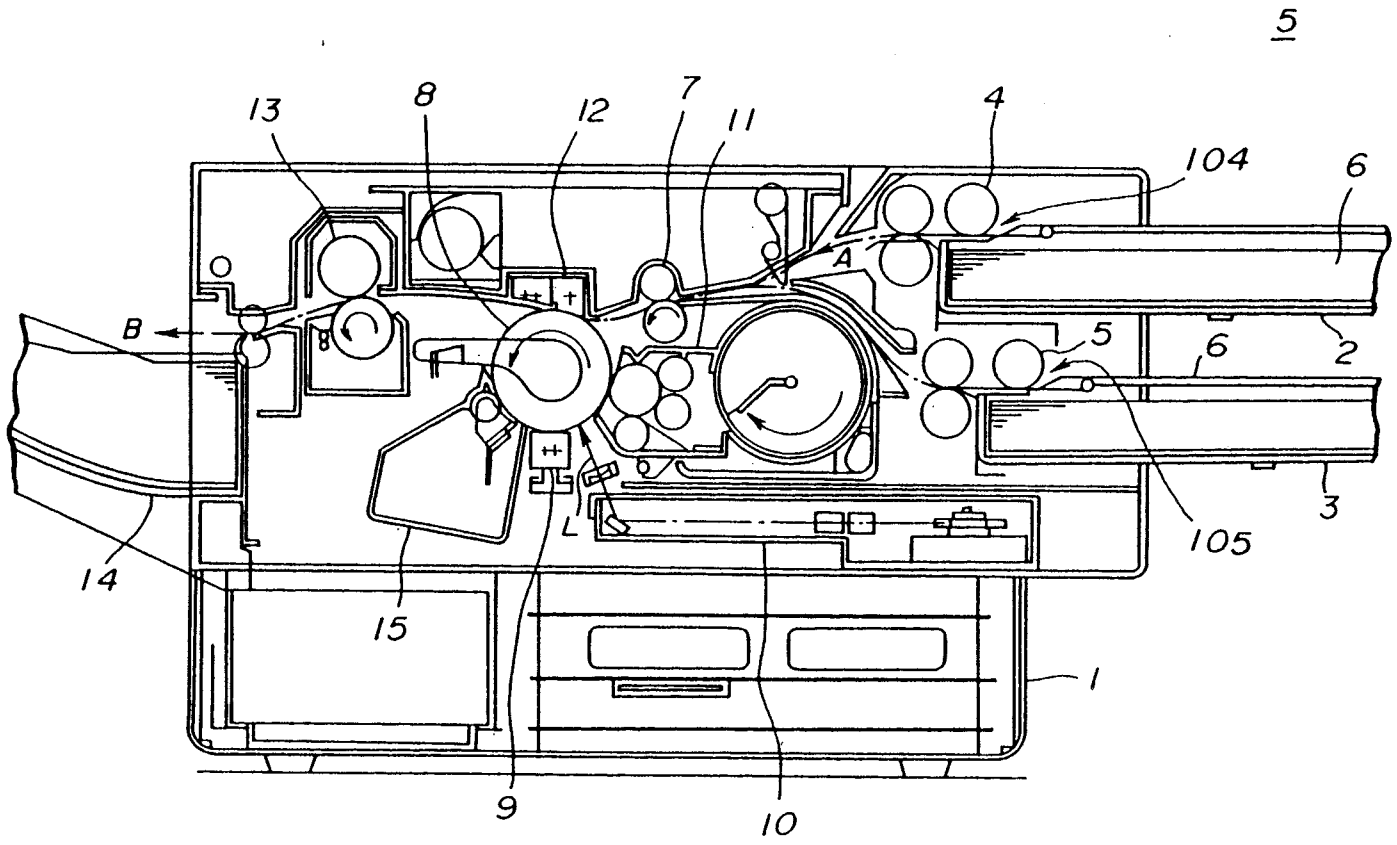
FIG. 21 is a sectional view of a laser printer in which an embodiment of duplex recording sheet transport control apparatus according to the present invention is incorporated.
Figure 22:
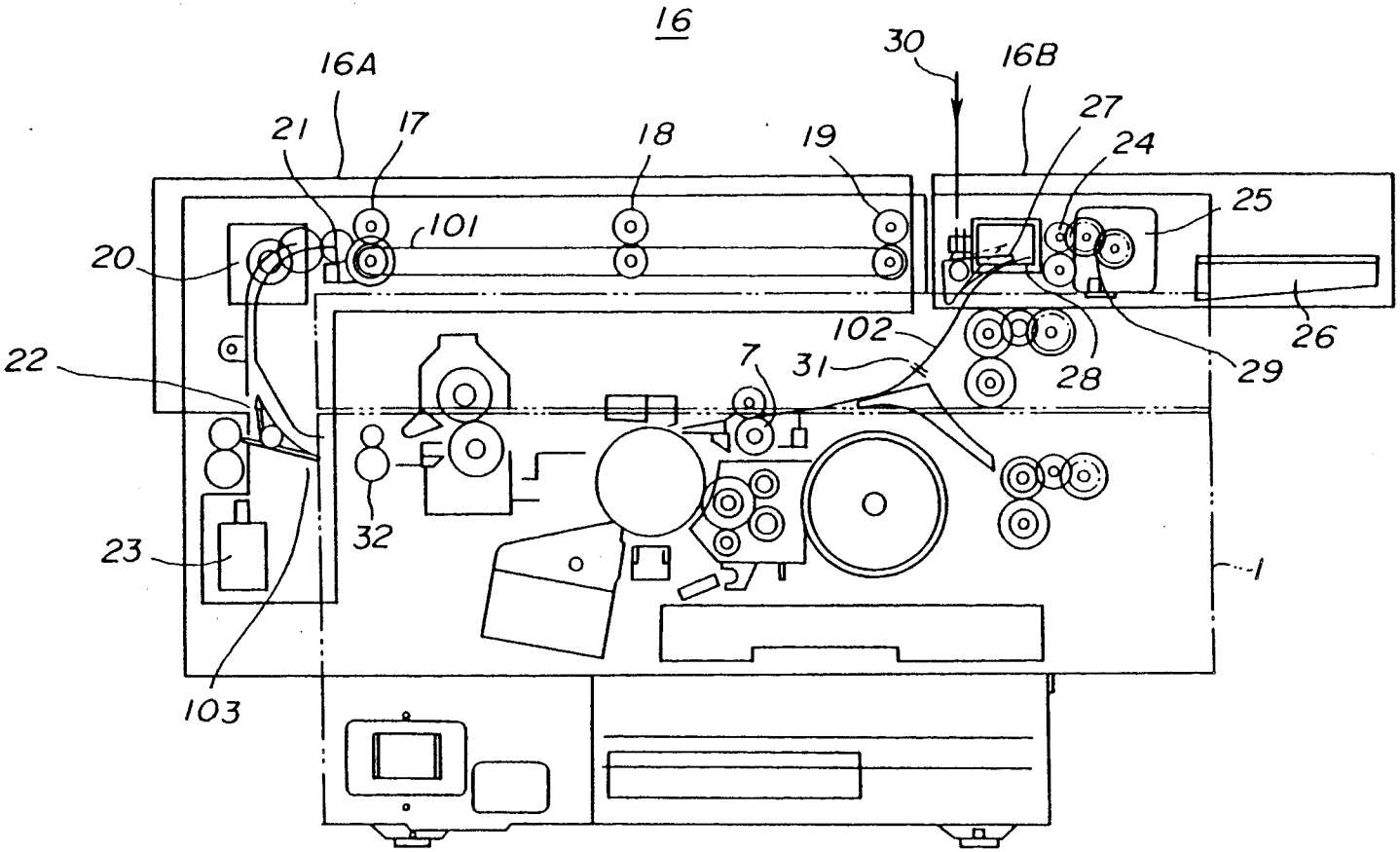
FIG. 22 is a sectional view of the laser printer shown in FIG. 21 to which the duplex recording apparatus is attached.

A description on the operation of this embodiment will be given below in conjunction with the timing chart in FIG. 18 and the partial enlarged views of the portions A and B in FIGS. 19 and 20.

Figure 18:
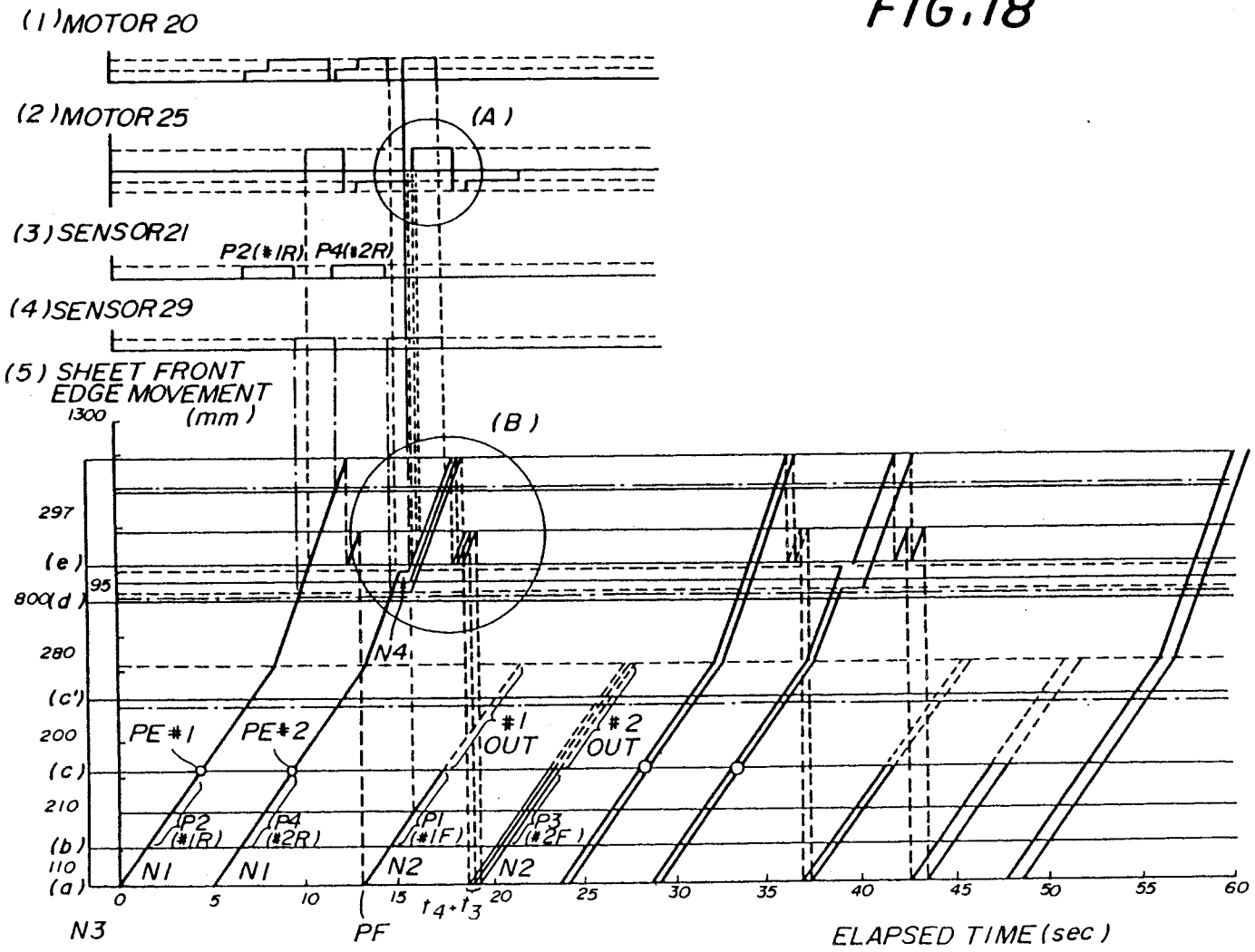
FIG. 18 is a timing chart used when the duplex recording of two sheets is carried out with this embodiment of the duplex recording apparatus.

FIG. 18 is a timing chart for explaining the duplex recording of two sheets. In this figure, the ON/OFF timings of the first drive motor 20, the second drive motor 25, the first paper sensor 21 and the second paper sensor 29, relative to the elapsed time, are shown in (1) through (4) respectively. And, (5) in FIG. 18 shows the movement of an A4 type sheet front edge relative to the elapsed time. The execution of the PE command which carries out the supplying of the sheets from the printer 1 into the first paper transport path 101 is indicated by N1. The execution of the PF command which carries out again the supplying from the switchback system 16B of the duplex recording apparatus 16 to the printer 1 is indicated by N2. N3 indicates the second paper waiting position 31, and, in the case where sheets are supplied from the upper paper feeding cassettes 2 or lower paper feeding cassette 3, it shows the relative position from the pair of registration rollers 7*b*. N4 indicates the waiting time interval of the second drive motor 25.

The distances between major positions including the points (a) through (e) and the linear speed of sheets (transport speed) in the printer 1 and in the duplex recording apparatus are set up as follows.

| Distance Between Major Positions (mm) | Linear Speed (mm/sec) |
|---|---|
| (a) - (b): 100 | 79.2 |
| (b) - (c): 207 | 72.0 |
| (c) - (c'): 200 | 72.0 |
| (c') - (d): 280 | 72.0→140.0 |
| (d) - (e): 95 | 140.0 |
| (e) - (a): 90 | 140.0 |

Where:
(a)=second paper waiting position 31
(b)=center of registration rollers 7 of printer
(c)=center of paper outlet rollers 32 of printer
(c')=center of first transport rollers 17
(d)=center of third transport rollers 19
(e)=center of switchback drive rollers 24

For example, with the printing speed for the standard specification being set to 12 PPM (pages per minute), the linear speed at the image forming portion of the printer is 72 mm/s, the paper feed distance 63 mm and the time interval between A4 paper feeds 5 sec (mm).

As shown in FIG. 18, the PE command is executed for the second sheet (P4: #2 reverse) at the point (c). And at the point (d) indicated by N4, with the sheet waiting at the first paper waiting position 30 for the second drive motor 25, the timing to start forward operation of the motor 25 is adjusted within the variable range of (±L3) to the standard distance L1 at the first waiting position 30, as indicated in FIGS. 19 and 20.

The PF command is executed by the control unit 35 of the printer at the point (a) indicated in the figure.

As described in the foregoing, with the second paper sensor provided in the switchback system of duplex recording apparatus as the above first embodiment, the sheet position is sensed slightly earlier than the timing of the drive signal of the second drive motor becoming open, and the first drive motor in the transport system of duplex recording system is driven and the subsequent sheets waiting at the first waiting position are more quickly transported to the switchback system for smaller paper feed time intervals. Accordingly, the problem with the conventional apparatus that the re-start of first drive motor be done after the second drive motor stops operation completely with the loss in the waiting time can be eliminated. According to the present invention, with smaller paper feed time intervals, the overall transport efficiency of duplex recording apparatus can be improved with no increase in the speed of transport rollers in the duplex recording apparatus.

Further, the second paper sensor provided on the downstream side of the switchback drive roller along the transport path would allow the paper detection especially when a sheet is supplied from the switchback tray into the printer, thereby providing the capability of manual paper feeding from the switchback portion when used with the printer.

In the second embodiment of the duplex recording apparatus according to the present invention, it is possible to make adjustable the first waiting position when a sheet is transported to the switchback system of duplex recording apparatus. This allows making adjustment of the recording sheet transport speed when used with the duplex recording apparatus without changing the linear speed of sheet transport. And the adjustment of the first paper waiting position can be made from the outside of the printer by storing the adjustment data in the CPU with a simple variable resistor, which provides the advantage in view of the cost.

Further, the present invention is not limited to these embodiments, but several variations and modifications may be made without departing from the scope of the present invention.

What is claimed is:

1. A duplex recording sheet transport control apparatus for controlling transport of a sheet in a duplex unit for a main recording apparatus, said duplex unit having a switchback system and a transport system, comprising:

a transport path from an outlet of said main recording apparatus through a first waiting position to a second waiting position;

first driving means for transporting the sheet from the outlet of said main recording apparatus through said transport path to said first waiting position;

second driving means for transporting the sheet temporarily waiting at said first waiting position to said switchback system and for switching back the sheet to said second waiting position;

first paper detection means for serving as a trigger to start operation of said first driving means to transport the sheet; and second paper detection means for serving as a trigger to start operation of said second driving means to transport the sheet;

said second paper detection means being provided at a position which is separated by a predetermined distance from said second driving means and allowing detection of the sheet slightly earlier than the timing of turning off of a drive signal to said second driving means, so that a re-start timing of transporting of the sheet by said first and second driving means is made earlier.

2. The duplex recording sheet transport control apparatus as claimed in claim 1, wherein said second paper detection means is provided on a downstream side of said second driving means along said sheet transport path.

3. The duplex recording sheet transport control apparatus as claimed in claim 2, wherein said second paper detection means is provided at a position which is separated by a distance determined by a sheet transport speed of the main recording apparatus from said second driving means.

4. The duplex recording sheet transport control apparatus as claimed in claim 1, further comprising a drive pulse counting means for counting the number of drive pulses sent to said first driving means starting from the timing of paper position being sensed, adjusting means for adjusting a predetermined count value for said paper waiting position to stop sending of drive pulses to said first driving means when the counted value by said drive pulse counting means reaches said predetermined count value, thereby making said first paper waiting position to be adjustable.

5. The duplex recording sheet transport control apparatus as claimed in claim 4, wherein said second paper detection means is provided on an upstream side of said first waiting position along said sheet transport path.

6. The duplex recording sheet transport control apparatus as claimed in claim 5, wherein said second paper detection means is provided at a position which is separated by a predetermined distance from said first waiting position.

* * * * *